US012065797B1

(12) United States Patent
Li et al.

(10) Patent No.: US 12,065,797 B1
(45) Date of Patent: Aug. 20, 2024

(54) ROD-TYPE PILE FOUNDATION FOR PREVENTING PILE BODY FROM BEING HEAVED AND OPERATING METHOD THEREOF

(71) Applicant: NORTHWEST INSTITUTE OF ECO-ENVIRONMENT AND RESOURCES, CAS, Gansu (CN)

(72) Inventors: Guoyu Li, Lanzhou (CN); Yapeng Cao, Lanzhou (CN); Sai Ying, Lanzhou (CN); Dun Chen, Lanzhou (CN); Qingsong Du, Lanzhou (CN)

(73) Assignee: NORTHWEST INSTITUTE OF ECO-ENVIRONMENT AND RESOURCES, CAS, Lanzhou (CN)

( * ) Notice: Subject to any disclaimer, the term of this patent is extended or adjusted under 35 U.S.C. 154(b) by 0 days.

(21) Appl. No.: 18/645,469

(22) Filed: Apr. 25, 2024

(30) Foreign Application Priority Data

Jun. 27, 2023 (CN) ..... 202310764851.2

(51) Int. Cl.
*E02D 31/14* (2006.01)
*E02D 5/80* (2006.01)

(52) U.S. Cl.
CPC ..... *E02D 31/14* (2013.01); *E02D 5/80* (2013.01); *E02D 2600/10* (2013.01)

(58) Field of Classification Search
CPC ..... E02D 5/80; E02D 5/801; E02D 31/14
USPC ..... 405/244
See application file for complete search history.

(56) References Cited

U.S. PATENT DOCUMENTS 1,982,687 A * 12/1934 O'Brien ..... E02D 5/54 405/257
2,468,729 A * 5/1949 Black ..... E02D 5/806 52/155
3,763,655 A * 10/1973 Galuska ..... E02D 5/54 52/158

(Continued)

FOREIGN PATENT DOCUMENTS

CN 201560713 U 8/2010
CN 202031482 U 11/2011

(Continued)

OTHER PUBLICATIONS

Decision to Grant a Patent in Chinese Application No. 202310764851.2 mailed on Sep. 8, 2023, 7 pages.

*Primary Examiner* — Frederick L Lagman
(74) *Attorney, Agent, or Firm* — METIS IP LLC

(57) ABSTRACT

The present disclosure provides a rod-type pile foundation for preventing a pile body from being heaved and an operating method. The rod-type pile foundation comprises a base, a support block fixed inside the base, a support plate movably disposed at a top of the support block by a guide structure, and an anti-frost heaving component located at a lower portion of the support block. The anti-frost heaving component includes a first connecting rod rotationally connected with the support block and one or more telescopic rods. One end of each of the telescopic rods is fixed on the first connecting rod. A scraping plate is fixed at another end of each of the telescopic rods. The support plate is in transmission connection with the first connecting rod through a transmission component. The transmission component converts a vertical linear motion of the support plate into a rotation of the first connecting rod.

16 Claims, 13 Drawing Sheets

(56) References Cited

U.S. PATENT DOCUMENTS

| | | | | | |
|---|---|---|---|---|---|
| 4,547,106 | A * | 10/1985 | Lipsker | E02D 5/803 405/262 |
| 5,975,808 | A * | 11/1999 | Fujita | E02D 5/523 405/253 |
| 6,435,777 | B1 * | 8/2002 | Yoshii | E02D 5/36 405/231 |
| 2014/0234030 | A1 * | 8/2014 | Chin | E02D 5/54 405/244 |

FOREIGN PATENT DOCUMENTS

| | | | | |
|---|---|---|---|---|
| CN | 102777135 | A | 11/2012 | |
| CN | 203161092 | U | 8/2013 | |
| CN | 105935719 | A | 9/2016 | |
| CN | 106958419 | A | 7/2017 | |
| CN | 109680686 | A * | 4/2019 | E02D 5/80 |
| CN | 109944269 | A | 6/2019 | |
| CN | 112177027 | A | 1/2021 | |
| CN | 112392039 | A * | 2/2021 | |
| CN | 113089733 | A | 7/2021 | |
| CN | 113266033 | A * | 8/2021 | E02D 27/35 |
| CN | 113356184 | A | 9/2021 | |
| CN | 113530454 | A | 10/2021 | |
| CN | 214697736 | U | 11/2021 | |
| CN | 113882397 | A * | 1/2022 | |
| CN | 114016541 | A | 2/2022 | |
| CN | 114016541 | A * | 2/2022 | |
| CN | 114263205 | A | 4/2022 | |
| CN | 114382079 | A * | 4/2022 | |
| CN | 114658364 | A | 6/2022 | |
| CN | 115492169 | A | 12/2022 | |
| CN | 218175819 | U | 12/2022 | |
| CN | 116122732 | A | 5/2023 | |
| JP | 7029869 | B1 | 3/2022 | |
| WO | 2018218900 | A1 | 12/2018 | |

* cited by examiner

1300

ROD-TYPE PILE FOUNDATION FOR PREVENTING PILE BODY FROM BEING HEAVED AND OPERATING METHOD THEREOF

CROSS-REFERENCE TO RELATED APPLICATIONS

This application claims priority to Chinese Patent Application No. 202310764851.2, filed on Jun. 27, 2023, the entire contents of which are hereby incorporated by reference.

TECHNICAL FIELD

The present disclosure relates to the technical field of pile foundations, and in particular, to a rod-type pile foundation for preventing a pile body from being heaved and an operating method thereof.

BACKGROUND

A frost heaving phenomenon (heaving of rocks, trees, and pile foundations), such as frost heaving trees, is that in high latitude and cold regions, when the soil moisture content is too high, trees rise due to the expansion of the soil by freezing, which also lift up plants. By the time of thawing in the spring, the soil sinks and the plants stay in place, causing the plant roots to die from exposure. Permafrost is soil and rock with a temperature below 0° C. and containing ice, which may be categorized into perennial permafrost and seasonal permafrost according to the duration of existence. Permafrost is widely distributed in China. Perennial permafrost regions and seasonal permafrost regions account for about 75% of China's land area. Perennial permafrost is soil that is in a frozen state for more than two years, with only the top few meters of soil thawing in summer and freezing in winter, which is also known as a seasonal active layer. Seasonal permafrost is soil that freezes in winter and thaws in summer only within a few meters of the surface, which is also known as a seasonal freezing layer or a seasonal active layer. That is to say, in both the perennial permafrost regions and the seasonal permafrost regions, there are layers of soil that freezes in winter and thaws in summer within a few meters of the surface.

In the cold regions, utility poles and other structures extensively utilize a rod-type pile foundation. These structures share the common characteristics of small load and self-weight and long and slender pile foundation. Under the alternating action of seasonal frost heaving and thawing settlement of the active layer, the pile foundation is highly susceptible to frost heaving damage. With the passage of time, the accumulation of frost heaving displacement leads to pulling out or overturning of the foundation. In the cold days, as the atmospheric temperature drops, the soil of the active layer freezes to expand in a vertical direction. However, the pile foundation changes the natural form of the frozen soil, causing the vertical frost heaving of the soil around the pile to be constrained, and the frozen soil to produce a tangential frost heaving force to the pile foundation to make the pile to be heaved. When the warm days come, the soil of the active layer thaws, an upward heaving force to the pile body disappears, and the pile foundation stays at an upward heaving position or produces a certain degree of settlement and tilting, but not goes back to an original position before the upward heaving as the support by the friction resistance of the soil on a pile side. Therefore, the pile body may produce a net upward heaving amount within one freezing and thawing cycle. With repeated cycles of freezing and thawing of the active layer, the pile foundation may repeat the above frost heaving process, and a frost heaving amount may keep accumulating and growing, which ultimately leads to an excessive cumulative frost heaving amount of the pile foundation, endangering the stability of an overlying engineering structure.

Therefore, it is desirable to provide a rod-type pile foundation for preventing a pile body from being heaved and an operating method thereof, which are capable of overcoming the upward frost heaving force, and avoiding the problem of endangering the stability of the overlying engineering structure caused by the tangential frost heaving force pulling the pile body to move upwardly, thereby prolonging the service life of the pile foundation, and ensuring the safety and stability of buildings and civil structures.

SUMMARY

One or more embodiments of the present disclosure provide a rod-type pile foundation for preventing a pile body from being heaved. The rod-type pile foundation may comprise a base, a support block fixed inside the base, a support plate movably disposed at a top of the support block by a guide structure, and an anti-frost heaving component located at a lower portion of the support block. The anti-frost heaving component may include a first connecting rod rotationally connected with the support block and one or more telescopic rods. One end of each of the one or more telescopic rods may be fixed on the first connecting rod. A scraping plate may be fixed at another end of each of the one or more telescopic rods. The scraping plate may protrude from an outer wall of the base when the one or more telescopic rods are in an extended state. The support plate may be in transmission connection with the first connecting rod through a transmission component. The transmission component may convert a vertical linear motion of the support plate into a rotation of the first connecting rod.

One or more embodiments of the present disclosure provide an operating method of a rod-type pile foundation for preventing a pile body from being heaved. The operating method may be performed by a controller. The operating method may comprise: fixing a scraping plate by a fixture, such that one or more telescopic rods may be in a compressed state, sinking a base to a bottom of a drilled hole, and removing the fixture, wherein a diameter of the drilled hole may be greater than a diameter of the base; in response to a placing operation instruction, placing a structure on a support plate, and driving the support plate to move downward; in response to determining that the support plate moves downward, a transmission component driving a first connecting rod to autorotate, the first connecting rod rotating to drive the scraping plate to rotate to scrape an inner wall of the bottom of the drilled hole, and in response to determining that the diameter of the drilled hole becomes larger during scraping, the one or more telescopic rods extending to drive the scraping plate to continue to contact with soil to continuously expand the soil until the support plate stops moving; and in response to a backfill operation instruction, backfilling the drilled hole to complete assembly of the structure.

BRIEF DESCRIPTION OF THE DRAWINGS

The present disclosure will be further illustrated by way of exemplary embodiments, which will be described in detail with reference to the accompanying drawings. These embodiments are not limiting, and in these embodiments, the same numbering denotes the same structure, wherein.

DETAILED DESCRIPTION

Figure 1:
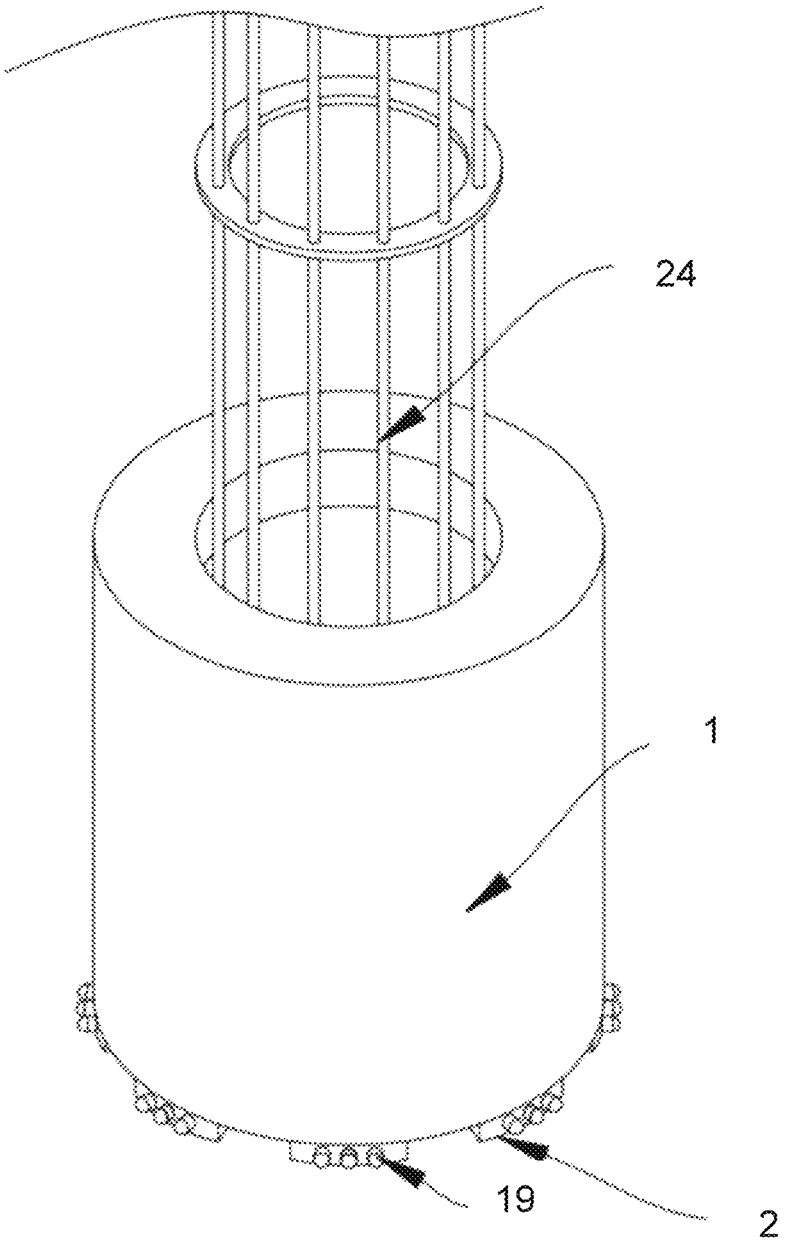
FIG. 1 is a schematic diagram illustrating an overall structure of a rod-type pile foundation according to some embodiments of the present disclosure.

In order to more clearly illustrate the technical solutions of the embodiments of the present disclosure, the following briefly introduces the drawings that need to be used in the description of the embodiments. Apparently, the accompanying drawings in the following description are only some examples or embodiments of the present disclosure, and those skilled in the art can also apply the present disclosure to other similar scenarios according to the drawings without creative efforts. Unless obviously obtained from the context or the context illustrates otherwise, the same numeral in the drawings refers to the same structure or operation.

It should be understood that "system", "device", "unit" and/or "module" as used herein is a method for distinguishing different components, elements, parts, portions or assemblies of different levels. However, the words may be replaced by other expressions if other words can achieve the same purpose.

As indicated in the disclosure and claims, the terms "a", "an" and/or "the" are not specific to the singular form and may include the plural form unless the context clearly indicates an exception. Generally speaking, the terms "comprising" and "including" only suggest the inclusion of clearly identified steps and elements, and these steps and elements do not constitute an exclusive list, and the method or device may also contain other steps or elements.

The flowchart is used in the present disclosure to illustrate the operations performed by the system according to the embodiments of the present disclosure. It should be understood that the preceding or following operations are not necessarily performed in the exact order. Instead, various steps may be processed in reverse order or simultaneously. Meanwhile, other operations may be added to these procedures, or a certain step or steps may be removed from these procedures.

A rod-type pile foundation refers to a free-standing foundation that uses a rod-type pile to carry and transfer a load from a superstructure (usually a column). A rod-type pile refers to a columnar force transmission rod with a stiffness and a bending capacity embedded into foundation soil.

Figure 2:
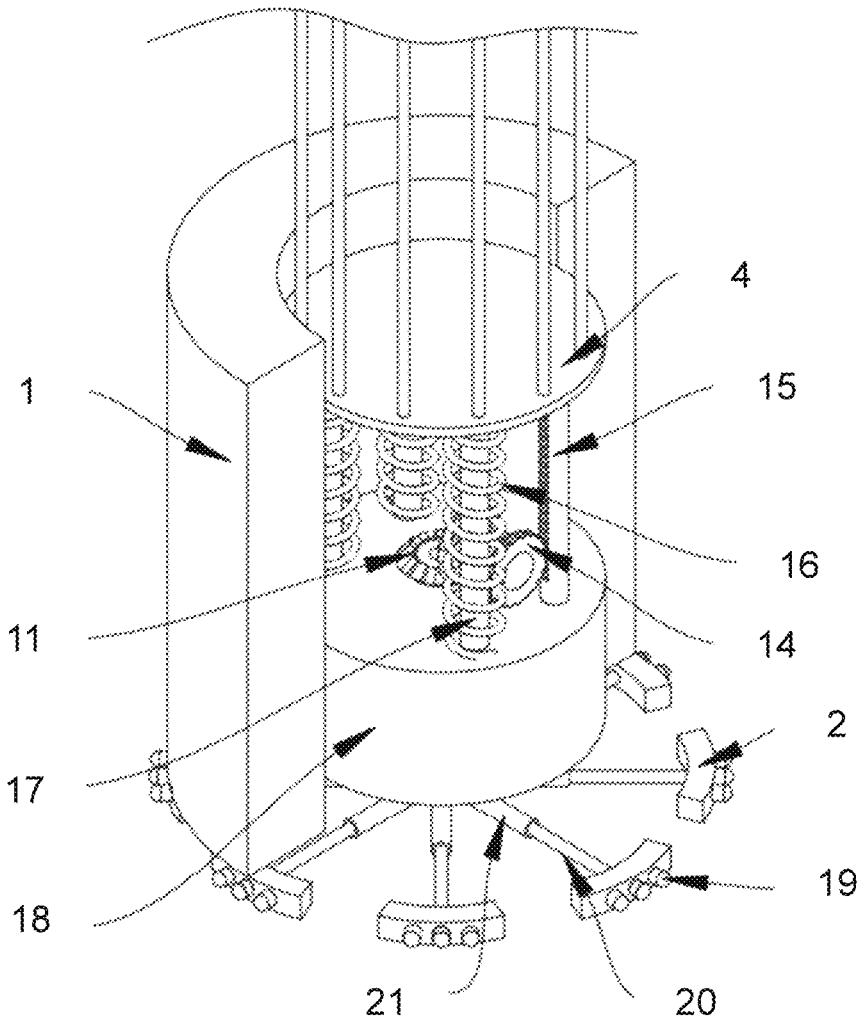
FIG. 2 is a schematic diagram illustrating an overall cross-sectional structure of a rod-type pile foundation according to some embodiments of the present disclosure.

In some embodiments, as illustrated in FIG. 1 and FIG. 2, a rod-type pile foundation for preventing a pile body from being heaved may include a base 1, a support block 18 fixed inside the base 1, a support plate 4 movably disposed at a top of the support block 18 by a guide structure, and an anti-frost heaving component disposed at a lower portion of the support block 18.

The base 1 refers to a bottom device of the rod-type pile foundation. In some embodiments, a material and a diameter size of the base 1 may be selected by a relevant technician based on an actual situation (e.g., a geological condition of a site of use, a load of a structure, a seismic intensity, etc.). For example, for a rod-type pile foundation for preventing a utility pole from being heaved, the base 1 may be a small-diameter (e.g., 300 mm) cylindrical base of concrete or concrete reinforced construction.

The structure is a man-made building or structure. In some embodiments, the structure may have only a base structure and a superstructure to carry a full load of an engineering facility. For example, as illustrated in FIG. 1, the structure may be a reinforced cage 24.

In some embodiments, a bottom end of the structure (e.g., the reinforced cage 24) may abut against the support plate 4.

The support block 18 refers to a block component that supports and bears the structure. In some embodiments, the support block 18 may be made of various materials and fixed on the base 1 in various ways. For example, the support block 18 may be made of metal (e.g., steel, etc.) and fixed on an inner wall of the base 1 by welding, mechanical anchoring, etc. In some embodiments, the support block 18 may be a non-solid structure. A portion of the guide structure and a transmission component may move in the support block 18.

In some embodiments, the support plate 4 may be disposed at a top of the support block 18, and an anti-frost heaving component may be located at a lower portion of the support block 18.

The support plate 4 refers to a plate component with strong support. For example, the support plate 4 may be a circular platform steel grating with high compression and bending resistance of average density, etc.

In some embodiments, an edge of the support plate 4 and the inner wall of the base 1 may slide relative to each other and need to be tightly connected to ensure that when the structure is assembled, the support plate 4 may move downward without any object leaking underneath the support plate to avoid damage to a lower structure. The means of tight connection may include, but is not limited to, mechanical sealing, or the like.

In some embodiments, an upper surface of the support plate 4 may abut against the bottom end of the structure (e.g., the reinforced cage 24), and a bottom surface of the support plate 4 may be connected with the guide structure.

The guide structure refers to a component for balancing a support plate. In some embodiments, the support plate 4 and the anti-frost heaving component may be movably disposed on the top and the lower portion of the support block 18 by the guide structure, respectively.

Figure 3:
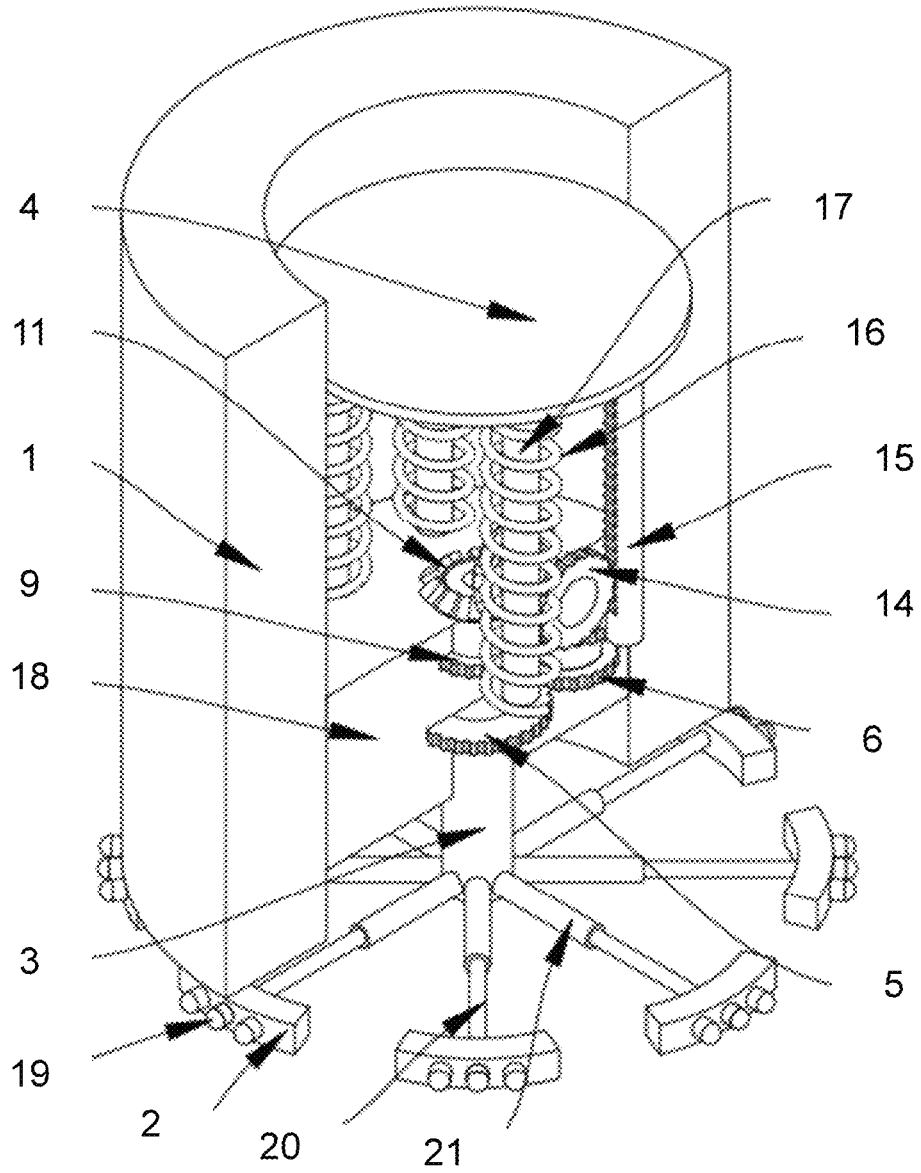
FIG. 3 is a schematic diagram illustrating a cross-sectional structure of a transmission component of a rod-type pile foundation according to some embodiments of the present disclosure.

In some embodiments, as illustrated in FIG. 3, the guide structure may include one or more second slide rods 17. One end of each of the one or more second slide rods 17 may be fixed on the bottom surface of the support plate 4. Another end of each of the one or more second slide rods 17 may be inserted into the support block 18 and movably connected with the support block 18. Each of the one or more second slide rods 17 may be externally sleeved with a first spring 16. One end of the first spring 16 may abut against the bottom surface of the support plate 4, and another end of the first spring 16 may abut against the upper surface of the support block 18.

The one or more second slide rods 17 refer to slide rods for supporting a vertical linear motion of the support plate 4 and moving with the support plate 4. For example, the one or more second slide rods 17 may be a high-strength load-bearing steel pipes, or the like.

In some embodiments, one end of each of the one or more second slide rods 17 may be fixed on the bottom surface of the support plate 4, and another end of each of the one or more second slide rods 17 may be inserted into the support block 18. As the support plate 4 moves downward, one end of each of the one or more second slide rods may move downward synchronously with the support plate 4, and the other end of the one or more second slide rods may move downward inside the support block 18.

In some embodiments, a count of the one or more second slide rods 17 may be a first number that is not less than a first threshold. The first number of the one or more second slide rods 17 may be distributed in a circumferential array with respect to an axis of the support plate 4.

The first number refers to a count of the second slide rods 17 arranged in the rod-type pile foundation. In some embodiments, the first number may not be less than the first threshold.

The first threshold refers to a minimum number of the second slide rods 17 that ensures proper operation of the rod-type pile foundation. In some embodiments, the first threshold may be predetermined by a technician or the system. For example, the first threshold may be 2.

A circumferential array distribution means that array objects are evenly distributed around a circumference. In some embodiments, the first number of the second slide rods 17 may be distributed in the circumferential array with respect to the axis of the support plate 4. The one or more second slide rods 17 may form a circumferential array. An axis of a center point (a center of the circumferential array) may be the axis (a central axis) of the support plate 4. A distance (a radius of the circumferential array) between the one or more second slide rods 17 and the center point may be less than a radius of the support plate.

In some embodiments of the present disclosure, a reasonable number of second slide rods distributed in the circumferential array ensures that the support plate 4 may smoothly slide downward along the inner wall of the base 1 in case of an extrusion force when the structure is assembled (e.g., concrete pouring of the reinforced cage 24), thereby ensuring the reliability of engagement between a first slide rod 15 and a fifth gear 14.

The first spring 16 refers to a spring device supporting the support plate 4, such as a steel plate spring with a circular cross-section, or the like.

In some embodiments, each of the one or more second slide rods 17 may be externally sleeved with the first spring 16. One end of the first spring 16 may abut against the bottom surface of the support plate 4, and the other end of the first spring 16 may abut against the upper surface of the support block 18. In some embodiments, as the support plate 4 moves downward, a distance between the bottom surface of the support plate 4 and the upper surface of the support block 18 may decrease, causing the first spring 16 to be compressed and undergo a compressive deformation due to an applied force.

In some embodiments of the present disclosure, the one or more second slide rod 17 may support the support plate 4 to ensure a stable isolation (e.g., preventing damage to the rod-type pile foundation caused by concrete leakage, or the like, underneath the support plate during concrete pouring) of the support plate 4. The first spring 16 may prevent the support plate 4 from moving downward when no structure is assembled, so that the base 1 may be prevented from activating the anti-frost heaving component to operate during a process of hole drilling, thereby preventing the anti-frost heaving component from damaging a hole wall and affecting a subsequent process.

The anti-frost heaving component refers to a component that has the effect of preventing a frost heaving phenomenon.

In some embodiments, as illustrated in FIG. 3, the anti-frost heaving component may include a first connecting rod 3 rotationally connected with the support block 18 and one or more telescopic rods. An end of each of the one or more telescopic rods may be fixed on the first connecting rod 3. A scraping plate 2 may be fixed at another end of each of the one or more telescopic rods. The scraping plate 2 may protrude from an outer wall of the base 1 when the one or more telescopic rods are in an extended state.

The first connecting rod 3 refers to a rod structure that connects the transmission component with the one or more telescopic rods, such as a steel rod with a sufficient support strength, or the like.

In some embodiments, a diameter of the first connecting rod 3 may be less than a diameter of the support plate. One end of the first connecting rod 3 may be rotationally connected on the support block 18, and another end of the first connecting rod 3 may protrude out of a bottom end of the base 1.

In some embodiments, an end of the first connecting rod 3 near the bottom end of the base 1 may be fixedly provided with the one or more telescopic rods. A connection between the one or more telescopic rods and the first connecting rod 3 may include welding, mechanical anchoring, or the like.

The one or more telescopic rods refer to rod structures with a telescopic function, such as a steel rod with sufficient hardness, or the like.

In some embodiments, a count of the telescopic rods may be a second number not less than a second threshold. The second number of the telescopic rods may be distributed in a circumferential array with respect to an axis of the first connecting rod 3.

The second number refers to a count of the telescopic rods provided in the rod-type pile foundation. In some embodiments, the second number may not be less than the second threshold.

The second threshold refers to a minimum number of the telescopic rods that ensures proper operation of the rod-type pile foundation. In some embodiments, the second threshold may be predetermined by a technician or the system. For example, the second threshold may be 3.

Figure 4:
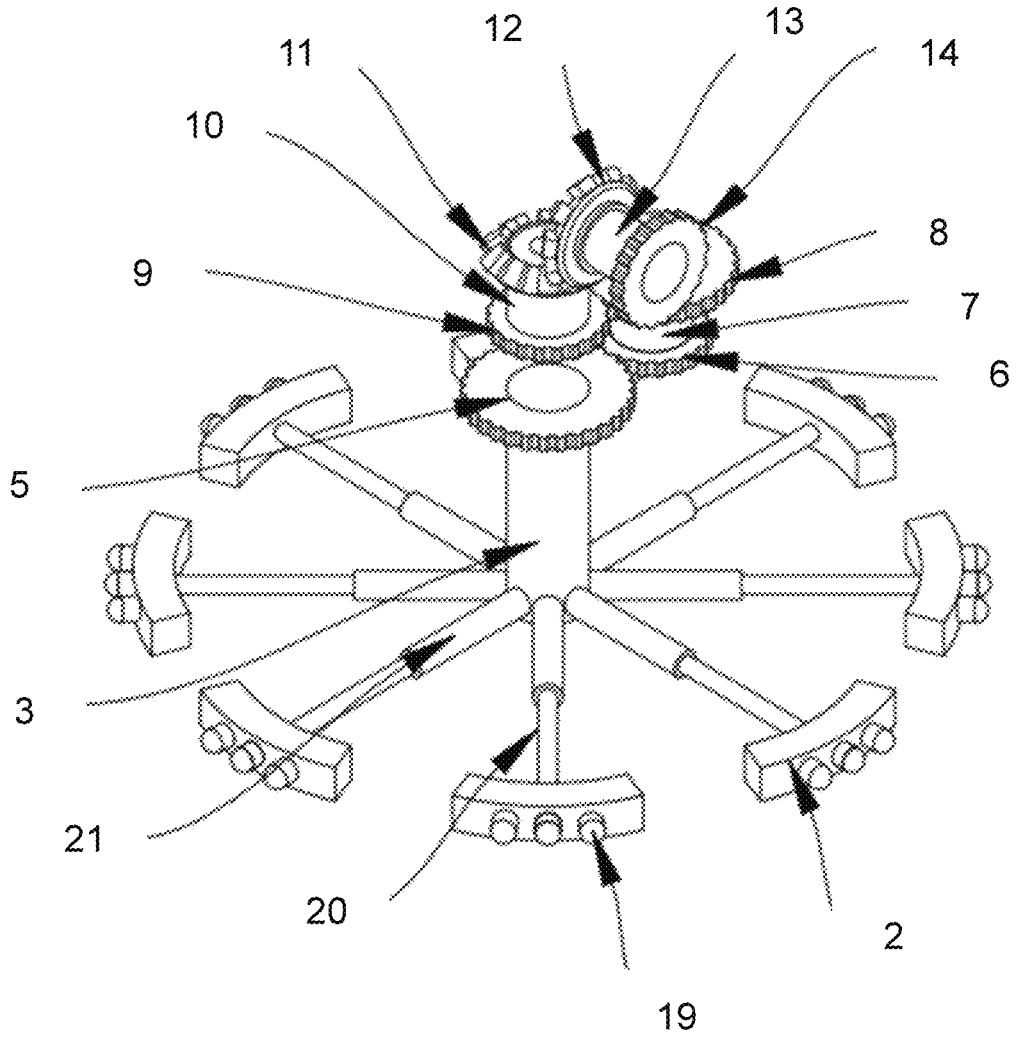
FIG. 4 is a schematic diagram illustrating a structure of a transmission component of a rod-type pile foundation according to some embodiments of the present disclosure.

In some embodiments, as illustrated in FIG. 4, the second number of the telescopic rods may be placed horizontally. The first connecting rod may be placed vertically (i.e., perpendicular to a plane formed by the telescopic rods). The telescopic rods may be distributed in the circumferential array with respect to the axis of the first connecting rod 3 (symmetrically distributed).

In some embodiments of the present disclosure, a reasonable number of the telescopic rods arranged in the circumferential array ensures that the one or more telescopic rods can rotate in a balanced manner when the first connecting rod 3 rotates, thereby achieving uniform expansion of the hole wall in a subsequent operation.

Figure 5:
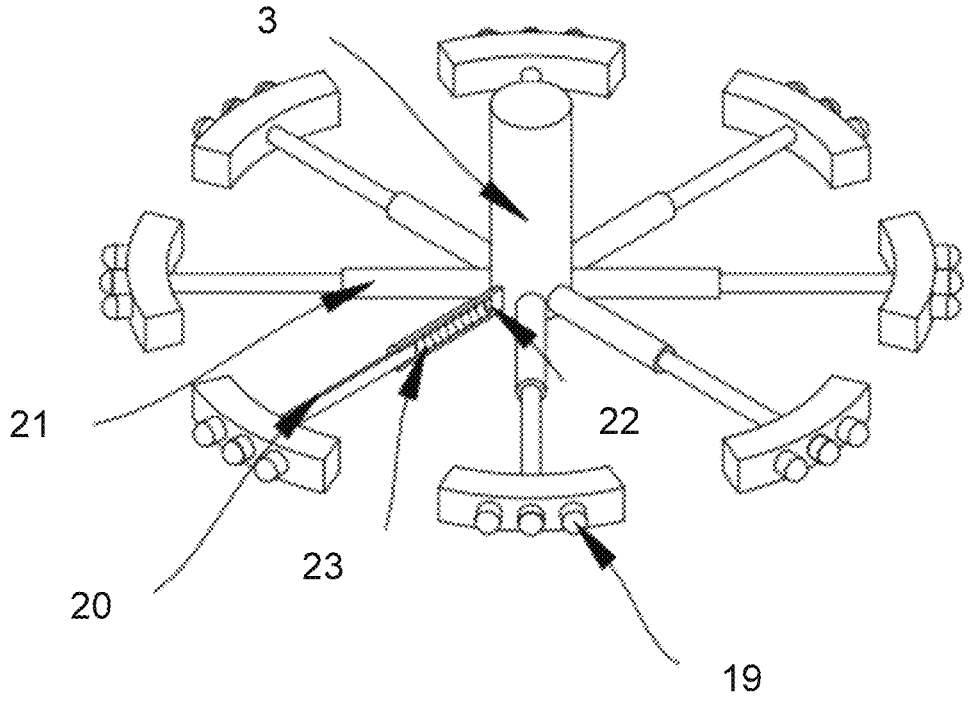
FIG. 5 is a schematic diagram illustrating a local cross-sectional structure of an anti-frost heaving component of a rod-type pile foundation according to some embodiments of the present disclosure.

In some embodiments, as illustrated in FIG. 5, each of the one or more telescopic rods may include a second movable rod 21 and a first movable rod 20 movably sleeved within and not disengaged from the second movable rod 21. One end of the second movable rod 21 may be fixed on a bottom sidewall of the first connecting rod 3. One end of the first movable rod 20 may be inserted into a slide groove 22 inside the second movable rod 21 through an opening in another end of the second movable rod 21 and squeeze a second spring 23 disposed in the slide groove 22. The scraping plate 2 may be fixed at another end of the first movable rod 20.

The second movable rod 21 refers to a rod structure fixedly connected with the first connecting rod 3. In some embodiments, the second movable rod 21 may be a hollow structure, such as a hollow steel pipe, etc. In some embodiments, an interior of the second movable rod 21 is referred to as the slide groove 22.

In some embodiments, one end of the second movable rod 21 may be fixed on the bottom sidewall of the first connecting rod 3. The bottom of the first connecting rod 3 refers to an end near the bottom end of the base 1. Fixing modes may include mechanical connection, chemical connection, or the like. In some embodiments, another end of the second movable rod 21 may be tubularly connected with the first movable rod 20.

The first movable rod 20 refers to a rod structure fixedly connected with the scraping plate 2. In some embodiments, the first movable rod 20 may be a hollow structure or a non-hollow structure, such as a solid steel rod, etc.

In some embodiments, a diameter of the first movable rod 20 may be than an inner diameter of the second movable rod 21, which ensures that the first movable rod 20 may be sleeved within the second movable rod 21. A sum of a length of the first movable rod 20 and a length of the second movable rod 21 may be greater than a diameter of the base, which ensures the expansion of the hole wall. One end of the first movable rod 20 may be inserted into the slide groove 22 inside the second movable rod 20 through the opening in the other end (i.e., the end not connected with the first connecting rod 3) of the second movable rod 21, and the other end of the first movable rod 20 may be fixedly connected with the scraping plate 2. Fixing modes may include mechanical connection, chemical connection, or the like.

The second spring 23 refers to a spring device that pushes the first movable rod 20 to move, such as a steel plate spring with a circular cross-section, or the like.

In some embodiments, the slide groove 22 inside each second movable rod 21 may be provided with one second spring 23. One end of the second spring 23 may abut against a bottom surface (i.e., a contact surface of the second movable rod 21 with the first connecting rod 3) of the slide groove 22, and another end of the second spring 23 may abut against one end (the end inserted into the second movable rod 20) of the first movable rod 20. In some embodiments, as a bottom of a hole expands, a diameter of the bottom of the hole may increase, a compression of the second spring 23 may decrease, and a compression amount of the second spring 23 may become smaller (a length of the second spring 23 restores continuously). The first movable rod 20 may move outward along the second movable rod 21 under the action of the second spring 23.

In some embodiments of the present disclosure, by means of the first movable rod 20, the second movable rod 21, and the second spring 23, a length of each of the one or more telescopic rods may be automatically changed based on the diameter of the bottom of the hole, so as to enable the scraping plate 2 to continue to contact with the hole wall and to continue to expand the bottom of the hole, thereby realizing the effect of automatic expansion. For example, after an inner wall of the bottom of the hole is scraped off, the first movable rod 20 may move outward along the second movable rod 21 under the action of the second spring 23, and the one or more telescopic rods may become longer.

The scraping plate 2 refers to a device that scrapes the inner wall of the bottom of the hole. In some embodiments, the scraping plate 2 may be made of a material (e.g., steel) that is less susceptible to deformation and has a relatively high hardness to ensure effective scraping of soil.

In some embodiments, the scraping plate 2 may be fixed at one end (the end of the first movable rod 20 away from the second movable rod 21) of each of the one or more telescopic rods. The scraping plate 2 may protrude from the outer wall of the base 1 when the one or more telescopic rods are in the extended state.

In some embodiments, as illustrated in FIG. 5, the scraping plate 2 may be a curved plate or a circular plate. One or more spherical rods 19 may be provided on an outer wall of the scraping plate 2. An end of each of the one or more spherical rods 19 may be spherical, and another end of each of the one or more spherical rods 19 may be rotatably connected with the scraping plate 2. The one or more spherical rods may be uniformly provided on a sidewall of the scraping plate 2.

The curved plate refers to the scraping plate 2 that is overall curved. For example, as illustrated in FIG. 5, the curved plate may be a three-dimensional structure with flat upper and lower surfaces and curved front and rear sidewalls. Each of the flat upper and lower surfaces may consist of two parallel arcs and two straight lines.

Figure 7A:
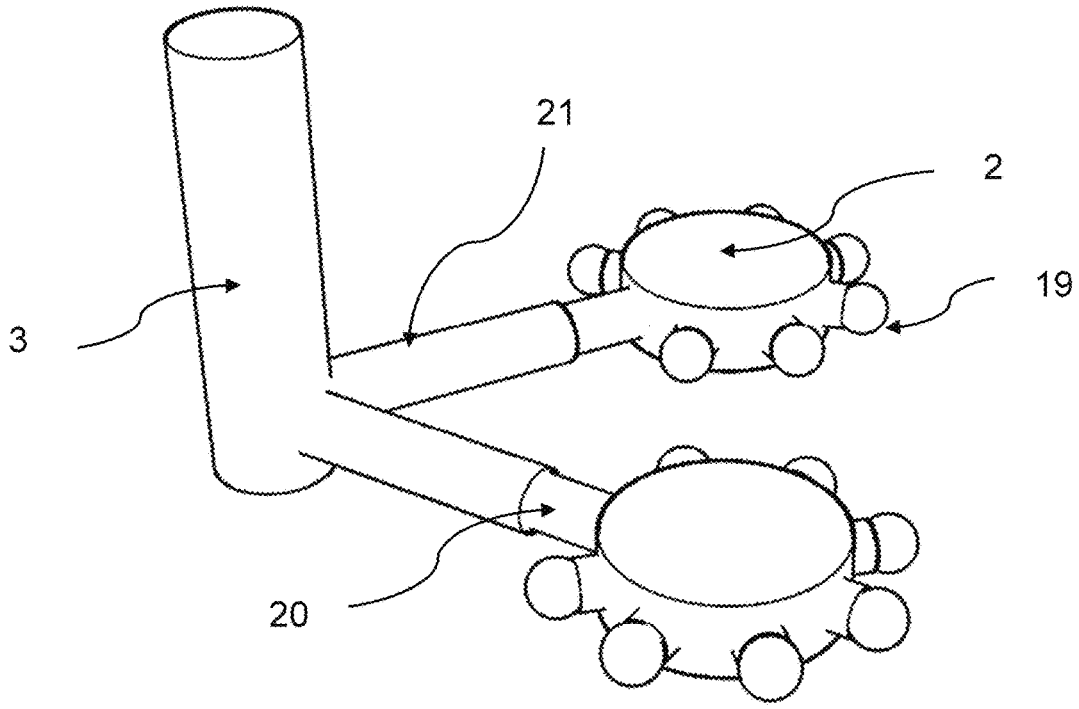
FIG. 7A is a schematic diagram illustrating a side view structure of a circular plate of a rod-type pile foundation according to some embodiments of the present disclosure.
Figure 7B:
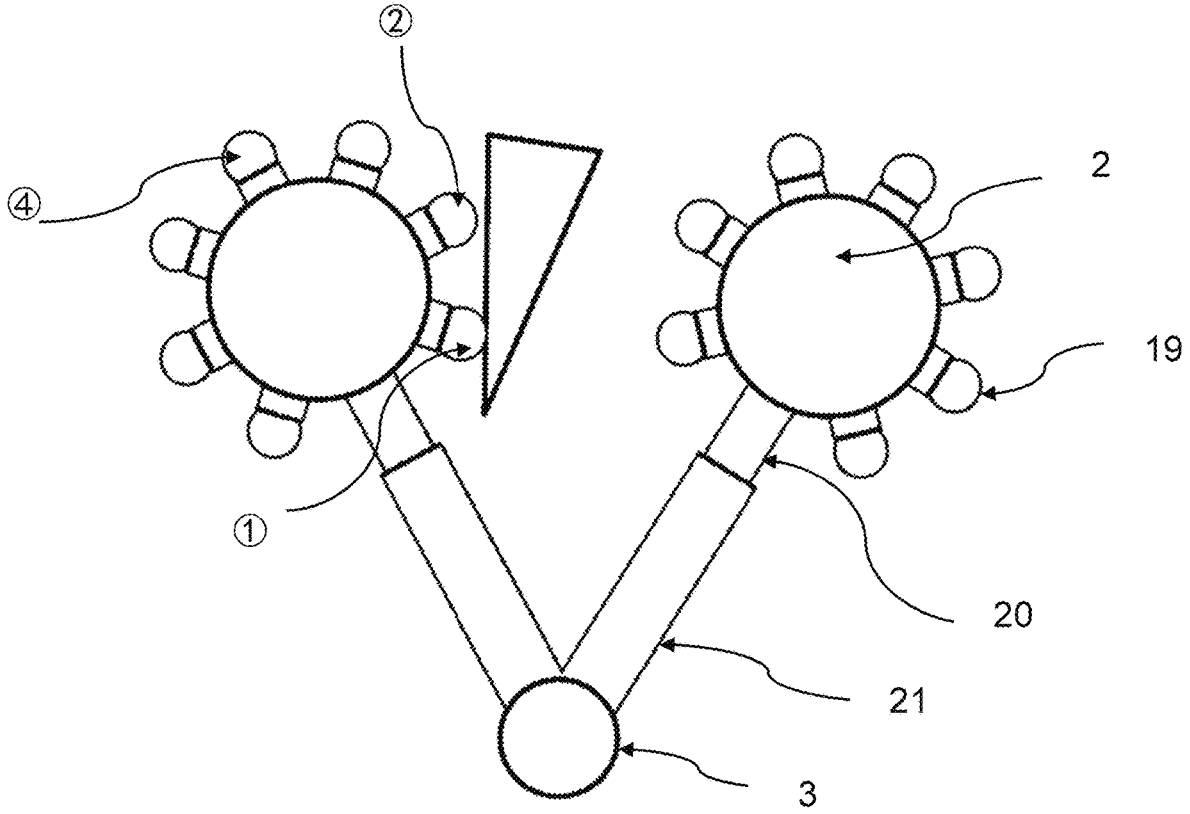
FIG. 7B is a schematic diagram illustrating a top view structure of a rod-type pile foundation according to some embodiments of the present disclosure.

The circular plate refers to the scraping plate 2 that is overall circular. As illustrated in FIG. 7A and FIG. 7B, the circular plate may be a cylindrical structure with circular upper and lower surfaces and curved sidewalls.

The one or more spherical rods 19 refer to a spherical rod structure configured to scrape the inner wall of the bottom of the hole. In some embodiments, the one or more spherical rods 19 may be provided on one side of the scraping plate 2 away from the second movable rod 21 and rotationally connected with the scraping plate 2. The one or more spherical rods 19 may be uniformly provided on the sidewall of the scraping plate 2. The end of each of the one or more spherical rods 19 may be spherical.

In some embodiments, tiny bumps may be uniformly provided on a surface of the spherical end of each of the one or more spherical rods 19. The material of the tiny bumps may be memory alloy.

The bumps refer to protruding block structures which are uniformly distributed on the spherical end (the end used to contact the soil).

The memory alloy refers to alloy that deforms under an external force and recover the shape at a certain temperature, such as a titanium-nickel alloy, a copper-zinc alloy, or the like.

In some embodiments of the present disclosure, the tiny bumps provided at the spherical end may be embedded into the soil when the scraping plate 2 rotates, and then be withdrawn from the soil by a pulling force of the scraping plate 2, leaving a gap between the soil. When the next scraping plate 2 makes contact, the soil may be more easily broken up due to the gap between the soil, thereby facilitating the scraping of the soil. Meanwhile, when stones that cannot be broken up appear, the stones may squeeze the tiny bumps, causing the tiny bumps to deform, thus not interfering with the rotation of scraping plate 2, and improving the stability of the device.

In some embodiments of the present disclosure, with the arrangement of the one or more spherical rods 19, when the hole wall is expanded, the one or more spherical rods 19 may be subjected to a tangential force to rotate, so that a sliding friction between the scraping plate 2 and the soil may be converted into a rolling friction between the soil and the one or more spherical rods 19, which may prevent the scraping plate 2 from getting stuck and stopping scraping the inner wall due to the stones during the expansion process, thus avoiding insufficient expansion of the area and failure of the anti-frost heaving component, and improving the reliability of the operation of the anti-frost heaving component.

The end of the one or more spherical rods 19 may be spherical because when the bottom of the hole is expanded, the contact surface between the spherical end and the soil is small, and the friction force is influenced by the contact area, the friction force between the one or more spherical rods 19 and the soil may decrease, thus not easily causing the problem of the scraping plate 2 getting stuck, and further improving the reliability of the device.

The curved plate may effectively fit the drilled hole, while the circular plate may be more effective at avoiding obstacles such as small and sharp rocks. For example, as illustrated in FIG. 7B, a stone with a relatively sharp front end is stuck between the adjacent circular plates, the one or more spherical rods 19 distributed at the front end of the circular plates may contact with the stone (e.g., the spherical rod 19 in contact may be labeled as (1). By using a force generated by the rotation of the first connecting rod 3 and a rotation of the one or more spherical rod 19, the spherical rod 19 in contact may be gradually adjusted to the spherical rod 19 at a more distal end along the first movable rod 20 (e.g., from (1) to (2) and then to 4, sequentially). In this process, a conversion of the force may be realized, so that the first movable rod 20 may be subjected to the force to expand and contract, that is, the first movable rod 20, the circular plate, and the one or more spherical rods 19 may contract inward as a whole, to avoid the stone. If the stone with the relatively sharp front end is stuck between the adjacent curved plates, the spherical rod may not play a role (unable to make the first movable rod 20 telescopic) due to the one or more spherical rods being arranged at front ends of the curved plates. In this case, the curved plates may be subjected to a force (the force generated by the rotation of the first connecting rod 3) that enables the curved plates to continue to rotate, and a resistance of the stone, which may be prone to damaging the scraping plate 2 and the transmission component.

Figure 6:
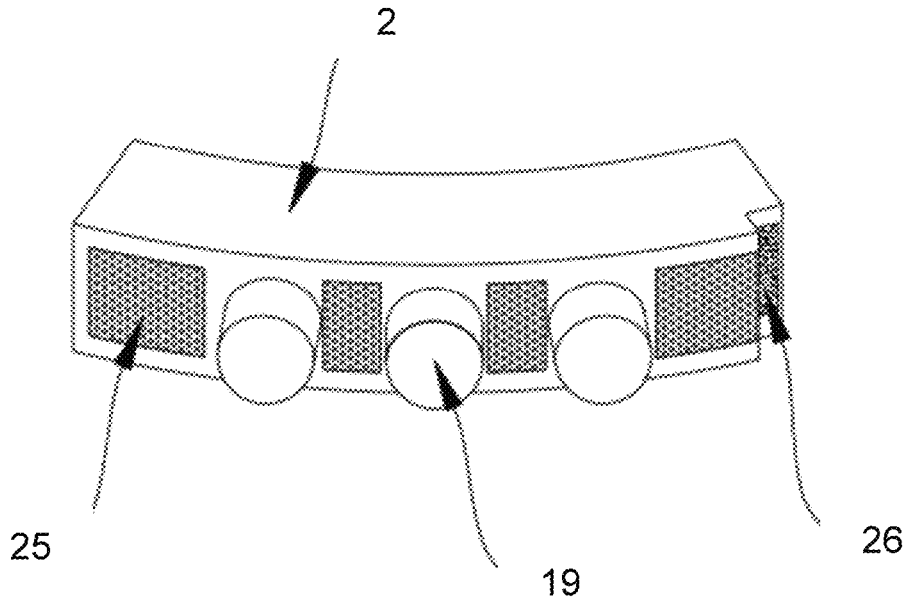
FIG. 6 is a schematic diagram illustrating a local cross-sectional structure of a scraping plate of a rod-type pile foundation according to some embodiments of the present disclosure.

In some embodiments, as illustrated in FIG. 6, a filter hole 25 may be provided in an outer wall plate of the scraping plate 2. A heater 26 or a temperature regulation device may be provided inside the scraping plate 2.

The filter hole 25 refers to a small hole that has a filtering effect. In some embodiments, mud, or the like, at the bottom of the hole may enter the interior of the scraping plate 2 through the filter hole 25 to contact with the heater 26.

The heater 26 refers to an object that produces an automatic heating effect through a chemical substance contained in the heater 26 that has a chemical reaction in contact with water to cause the release of heat, such as a thermosetting resin, or the like.

The temperature regulation device refers to a device with a temperature regulation function (mainly heating up), such as a heating block, or the like. In some embodiments, when the temperature regulation device is provided inside the scraping plate 2, heat may be produced without contacting with water, and damage to the temperature regulation device (e.g., a short circuit, etc.) caused by an object such as mud entering the interior of the scraping plate may be avoided. Therefore, the filter hole 25 may not be provided in the outer wall plate of the scraping plate 2.

In some embodiments, the temperature regulation device may perform temperature regulation based on a temperature regulation instruction. More descriptions regarding the temperature regulation instruction may be found in the related descriptions of FIG. 8.

In some embodiments of the present disclosure, the bottom of the hole may be heated by the heater 26 or the temperature regulation device to heat the soil, and the water between the soil may be converted from a solid state to a liquid state, making the soil soft, thus facilitating the expansion of bottom of the hole by the scraping plate 2. Meanwhile, the heat may assist the bumps in recovery, which is favorable for further scraping of the soil.

The transmission component refers to a component that drives the first connecting rod 3 to rotate.

In some embodiments, as illustrated in FIG. 3, the support plate 4 may be in transmission connection with the first connecting rod 3 through the transmission component. The transmission component may convert a vertical linear motion of the support plate 4 into the rotation of the first connecting rod 3.

In some embodiments, as illustrated in FIG. 3 and FIG. 4, the transmission component may include a first slide rod 15, a first gear 5 coaxially fixed on the first connecting bar 3, a second gear 6 and a third gear 8 which are coaxially provided, a second bevel gear 12 and a fifth gear 14 which are coaxially provided, and a fourth gear 9 and a first bevel gear 11 which are coaxially provided. A top of the first slide rod 15 may be fixed on a bottom surface of the support plate 4. A sidewall of the first slide rod 15 may be uniformly provided with toothed blocks. The first slide rod may be meshed with the fifth gear 14. The fifth gear 14 coaxially may drive the second bevel gear 12 to rotate. The second bevel gear 12 may be meshed with the first bevel gear 11. The first bevel gear 11 may coaxially drive the fourth gear 9 to rotate. The fourth gear 9 may be meshed with the third gear 8. The third gear 8 may coaxially drive the second gear 6 to rotate. The second gear 6 may be meshed with the first gear 5.

A mesh connection refers to a connection in which a motion and power of a driving wheel (shaft) are transmitted to a driven wheel (shaft) through a meshing action of gears to obtain a required speed and torque.

The first slide rod 15 refers to a slide rod that connects the support plate with a gear component. In some embodiments, the first slide rod 15 may convert downward sliding of the support plate 4 into a rotation of the fifth gear 14.

In some embodiments, when the support plate 4 slides downward, the support plate 4 may drive the first slide rod 15 to move downward. The first slide rod 15 may move to drive the fifth gear 14 to rotate. The fifth gear 14 may rotate to drive the second bevel gear 12 to rotate through a fourth connecting rod 13. The second bevel gear 12 may rotate to drive the first bevel gear 11 to rotate. The first bevel gear 11 may rotate to drive the fourth gear 9 to rotate through a third connecting rod 10. The fourth gear 9 may rotate to drive the third gear 8 to rotate. The third gear 8 may rotate to drive the second gear 6 to rotate through the second connecting rod 7. The second gear 6 may rotate to drive the first gear 5 to rotate, thereby driving the first connecting rod 3 to rotate. The fourth connecting rod 13, the third connecting rod 10, and the second connecting rod 7 may all be rotationally disposed on the support block 18, and may only rotate on the support block 18 without any displacement.

In a series of transmissions, a transmission between the fifth gear 14 and the first slide rod 15 may convert the linear motion into the rotation, a transmission between the second bevel gear 12 and the first bevel gear 11 may change a direction of rotation (from a rotation in a vertical plane to a rotation in a horizontal plane), and a transmission between the fourth gear 9 and the third gear 8 and a transmission between the second gear 6 and the first gear 5 may change a speed of rotation (slower rotation with more teeth, and faster rotation with fewer teeth) of the first gear 5 based on a count of gear teeth.

In some embodiments of the present disclosure, the support plate 4 may drive the scraping plate to rotate when the support plate 4 slides downward according to the transmission component, and control the scraping plate 2 to rotate a plurality of revolutions by changing the count of the plurality of gear teeth, avoiding fewer revolutions of the scraping plate 2 caused by a limited sliding distance of the support plate 4, and the failure of the anti-frost heaving component caused by not forming a pivot point of the scraping plate 2 as the difficulty in expanding the bottom of the hole due to a relatively tight soil structure at the bottom of the hole, thereby improving the stability of the device. In addition, a movement distance and the count of revolutions of the scraping plate 2 may be designed based on an actual situation of the soil detected in advance.

In some embodiments of the present disclosure, with the application of the rod-type pile foundation composed of the base, the support plate, the guide structure, the support block, or the like, the anti-frost heaving component can be controlled by squeezing the support plate to form a relatively large base at the bottom of the hole after the structure is assembled (e.g., after the concrete is poured for the reinforced cage), thus forming the pivot point to overcome the upward freezing and expansion force, and avoiding the problem of endangering the stability of the superstructure by the upward tangential freezing and expansion force of pulling the pile body in winter, thereby prolonging the service life of the pile foundation, and ensuring the safety and stability of buildings and civil structures.

In some embodiments, the rod-type pile foundation may be provided with a storage battery. At least one spherical rod 19 may be provided with a temperature sensor. A portion of bottoms of the plurality of the second movable rods 21 connected with the second spring 23 may be provided with a pressure sensor. The temperature regulation device, the temperature sensor, and the pressure sensor may be electrically connected with the storage battery. The temperature regulation device, the temperature sensor, and the pressure sensor may be in communicating connection with a controller and a storage.

The storage battery refers to a battery with stored power, such as a relatively large capacity lithium battery resistant to a low temperature. In some embodiments, the storage battery may be electrically connected with the temperature regulation device, the temperature sensor, and the pressure sensor to provide electrical power to the temperature regulation device, the temperature sensor, and the pressure sensor. An electrical connection refers to a connection that links an electronic component to another component via a wire, a plug, or the like, allowing the flow of electrical current. Electrical connection modes may include a soldering connection, a crimping connection, a plug-and-play connection, or the like.

The temperature sensor refers to a sensing device for detecting temperature, such as a low-temperature-resistant temperature sensor, or the like. In some embodiments, the temperature sensor may be provided inside the one or more spherical rods.

The pressure sensor refers to a sensing device for detecting pressure, such as a piezoresistive pressure sensor, or the like. In some embodiments, the pressure sensor may be provided at the portion of the bottoms (a contact surface of the plurality of second movable rods 21 with the first connecting rod 3) of the plurality of second movable rods 21 connected with the second spring 23.

In some embodiments, the temperature regulation device, the temperature sensor, and the pressure sensor may be in communicating connection with the controller and the storage to realize transfer and exchange of information and/or data between various components. For example, the temperature sensor and the pressure sensor may send temperature data and final pressure data to the controller and the storage. As another example, the controller may send the temperature regulation instruction to the temperature regulation device, etc. Communication connection modes may include a network, Bluetooth, or the like.

The storage refers to a device with a storage function. In some embodiments, the storage may be configured to store data, instructions, and/or any other information. In some embodiments, the storage may be configured to store data and/or information during processing by the controller, such as soil data, temperature data, a candidate temperature parameter, a structure parameter, an anti-frost heaving parameter, or the like.

In some embodiments, the storage may include one or more storage components. Each of the one or more storage components may be a stand-alone device or may be part of other devices. In some embodiments, the storage may include a random access memory (RAM), a read-only memory (ROM), or the like.

The controller refers to a device configured to process data and/or information from other components or external data sources (e.g., a cloud data center). In some embodiments, the controller may include a central processing unit (CPU), a digital signal processor (DSP), a computer, or the like, or any combination thereof.

In some embodiments, the controller may be configured to: obtain soil data and temperature data collected by the temperature sensor; generate candidate temperature parameters; determine, based on the soil data and the temperature data, an expansion effect corresponding to each candidate temperature parameter; determine the candidate temperature parameter of which the expansion effect satisfies a predetermined requirement as a target temperature parameter; and generate, based on the target temperature parameter, the temperature regulation instruction and send the temperature regulation instruction to the temperature regulation device.

More descriptions regarding the above data may be found in the related descriptions below.

Figure 8:
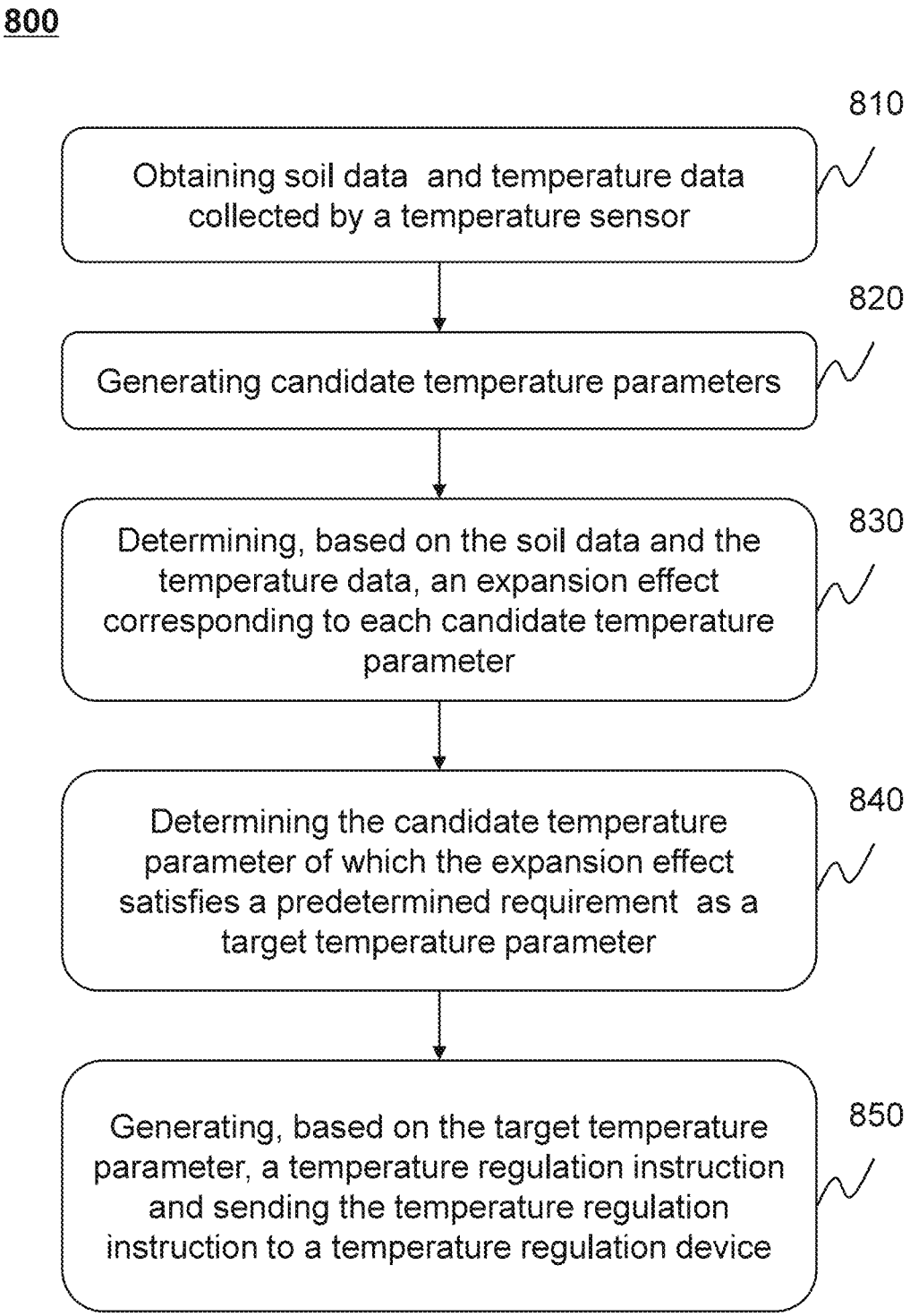
FIG. 8 is a flowchart illustrating an exemplary process for generating a temperature regulation instruction according to some embodiments of the present disclosure.

FIG. 8 is a flowchart illustrating an exemplary process for generating a temperature regulation instruction according to some embodiments of the present disclosure. As illustrated in FIG. 8, a process 800 may be executed by a controller. The processor 800 may include the following operations.

In 810, soil data and temperature data collected by a temperature sensor may be obtained.

The soil data refers to relevant data capable of characterizing soil, such as content of soil constituents (moisture, salinity, pH, total nitrogen, ammonium nitrogen, alkaline dissolved nitrogen, effective phosphorus, effective potassium, calcium and magnesium, sheds, etc.).

In some embodiments, the controller may obtain the soil data in various ways. For example, a soil sample may be collected by a technician from a region to be equipped with the rod-type pile foundation. The soil data may be measured by a soil nutrient tachymeter and stored in the storage. The controller may retrieve the soil data from the storage.

The temperature data refers to a temperature of a bottom (soil) of the base 1 of the rod-type pile foundation, such as 1° C., 0° C., −2° C., or the like. In some embodiments, the controller may obtain the temperature data in various ways. For example, the temperature data collected by the temperature sensor may be directly obtained through a communication connection.

In 820, candidate temperature parameters may be generated.

A temperature parameter refers to an operating temperature of the temperature regulation device. The candidate temperature parameters refer to candidate values for the operating temperature of the temperature regulation device after regulation, such as 5° C., 10° C., or the like.

In some embodiments, the controller may generate the candidate temperature parameters in various ways. For example, the controller may construct a first vector database. The first vector database may include a plurality of reference vectors and reference temperature parameters corresponding to the plurality of reference vectors. Each of the reference temperature parameters may be constructed based on historical soil data and the historical temperature data. The reference temperature parameters may be constructed based on historical actual temperature parameters corresponding to the plurality of reference vectors.

The controller may construct a first target vector based on current soil data and current temperature data; and determine, based on the first target vector, a plurality of reference vectors that satisfy a first predetermined condition in the first vector database through vector matching, take minimum and maximum values of the plurality of reference temperature parameters corresponding to the plurality of reference vectors, and randomly generate a first predetermined number of candidate temperature parameters within a range from the minimum value to the maximum value. The first predetermined condition and the predetermined number may be preset by a technician or set by system default. For example, the first predetermined condition may be that a vector distance (e.g., a Euclidean distance, etc.) between the first target vector and the plurality of reference vectors is less than a distance threshold (predetermined by the technician based on experience). The first predetermined number may be 5, 10, etc.

In 830, an expansion effect corresponding to each of the candidate temperature parameters may be determined based on the soil data and the temperature data.

The expansion effect refers to a quantity used to measure an extent to which the one or more telescopic rods expand the bottom of the hole. In some embodiments, the expansion effect may be represented by a pressure data sequence. The pressure data sequence refers to a sequence including a plurality of pressure data collected by a plurality of pressure sensors. The plurality of pressure sensors may be arranged at the portion of the bottoms of the plurality of second movable rods 21 connected with the second spring 23. The smaller the pressure average (i.e., an average of the plurality of pressure data of the pressure data sequence), the better the expansion effect.

In some embodiments, the controller may determine, based on the soil data and the temperature data, the expansion effect corresponding to each of the candidate temperature parameters in various ways. For example, the controller may supplementally construct the first vector database. The first vector database may further include reference expansion effects corresponding to the plurality of reference vectors. The reference expansion effects may be constructed based on historical actual expansion effects corresponding to the plurality of reference vectors.

The controller may determine, based on the first target vector, a plurality of reference vectors that satisfy a second predetermined condition in a supplemented first vector database through vector matching, and determine the reference expansion effects corresponding to the plurality of reference vectors as the expansion effects. The second predetermined condition and the predetermined number may be preset by the technician or set by system default. For example, the second predetermined condition may be that a vector distance between the first target vector and the plurality of reference vector is minimal.

Figure 9:
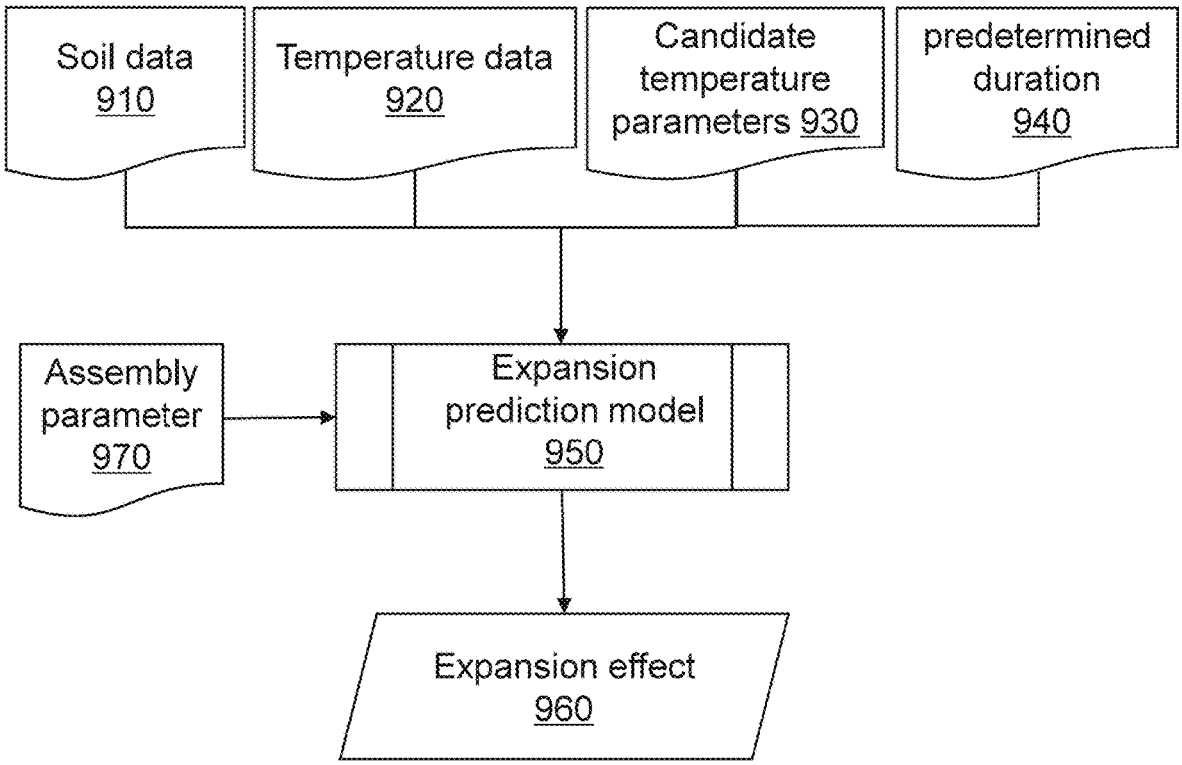
FIG. 9 is a schematic diagram illustrating an exemplary expansion prediction model according to some embodiments of the present disclosure.

In some embodiments, as illustrated in FIG. 9, the controller may be further configured to: determine, based on soil data 910, temperature data 920, candidate temperature parameters 930, and a predetermined duration 940, an expansion effect 960 through an expansion prediction model 950.

The predetermined duration 940 refers to a predetermined operating time of the scraping plate 2 for expansion. In some embodiments, the predetermined duration 940 may be preset by the technician or set by system default, such as 3 min, 5 min, or the like.

The expansion prediction model 950 refers to a model configured to predict the expansion effect. In some embodiments, the expansion prediction model 950 may be a machine learning model, such as neural networks (NN), etc.

In some embodiments, as illustrated in FIG. 9, an input of the expansion prediction model 950 may include the soil data 910, the temperature data 920, the candidate temperature parameters 930, and the predetermined duration 940, and the output of the expansion prediction model 950 may include the corresponding expansion effect 960 after the candidate temperature parameters operate for the predetermined duration.

In some embodiments, the controller may use sample soil data, sample temperature data, a sample temperature parameter, and a sample predetermined duration as a first training sample, and use a corresponding historical actual expansion effect after the sample temperature parameter operates for the sample predetermined duration as a first label corresponding to the first training sample. The expansion prediction model may be trained using the first training sample and the first label. The first training sample may be obtained based on historical data, and the first label may be a historical actual pressure data sequence corresponding to the first training sample.

In some embodiments, the controller may construct a first loss function based on the expansion effect (the pressure data sequence) output by the expansion prediction model and the first label (the historical actual pressure data sequence), update a parameter using the first loss function, and obtain a trained expansion prediction model through parameter updating. Parameter updating modes may include, but are not limited to, gradient descent or other iterative methods. An update completion condition may be that the first loss function is less than a first threshold, the first loss function converges, a training period reaches a threshold, or the like, or any combination thereof.

In some embodiments, as illustrated in FIG. 9, the input of the expansion prediction model 950 may also include an assembly parameter 970.

The assembly parameter 970 refers to a relevant parameter of assembling a structure. For example, when the structure is the reinforced cage 24, the assembly parameter may include a concrete pouring rate. In some embodiments, the assembly parameter may be set by the technician as appropriate. For example, the concrete pouring rate may be 30 $m^3$/h.

In some embodiments of the present disclosure, the assembly parameter may affect a rotation speed of the scraping plate 2, and thus affecting the expansion effect. Accordingly, the assembly parameter may be added to the input of the model to enhance the accuracy of the expansion prediction effect of the expansion prediction model.

In some embodiments, the first training sample may also include a sample assembly parameter. The expansion prediction model may be trained using the first training sample and the first label. The sample assembly parameter may include a historical assembly parameter. A training mode may be similar to the process described above, which is not further elaborated here.

In some embodiments of the present disclosure, the expansion effect may be accurately and quickly determined based on soil data, the temperature data, the candidate temperature parameters, and the predetermined duration through the machine learning model, which is helpful for the reasonable selection of a subsequent target temperature parameter.

In 840, a candidate temperature parameter of which the expansion effect satisfies a predetermined requirement may be determined as a target temperature parameter.

The target temperature parameter refers to a finally determined temperature parameter capable of achieving a satisfactory expansion effect, such as 10° C., or the like.

The predetermined requirement refers to a requirement of designating a candidate temperature parameter as the target temperature parameter. In some embodiments, the predetermined requirement may be set by the technician based on experience. For example, the predetermined requirement may include using an average of the candidate temperature parameters corresponding to the pressure averages of a plurality of pressure data sequences corresponding to the plurality of candidate temperature parameters less than a pressure threshold (determined by the technician based on experience) as the target temperature parameter, or selecting the candidate temperature parameter corresponding to a minimal pressure average less than the pressure threshold as the target temperature parameter.

In some embodiments, when none of the pressure averages are less than the pressure threshold, the controller may regenerate the candidate temperature parameters and determine the expansion effects corresponding to the candidate temperature parameters until the candidate temperature parameter of which the expansion effect satisfies the predetermined requirement is obtained. The controller may regenerate the candidate temperature parameters in various ways. For example, a candidate temperature parameter corresponding to a current minimal pressure average may be determined, and a predetermined number of new candidate temperature parameters less than the candidate temperature parameter may be randomly generated.

In 850, a temperature regulation instruction may be generated based on the target temperature parameter, and the temperature regulation instruction may be sent to the temperature regulation device.

The temperature regulation instruction refers to an instruction for controlling temperature regulation of the temperature regulation device. In some embodiments, the controller may automatically generate the temperature regulation instruction based on the target temperature parameter through a predetermined algorithm (e.g., a call function, etc.).

In some embodiments, the controller may send the temperature regulation instruction to the temperature regulation device via a network, or the like. The temperature regulation device may receive the temperature regulation instruction and begin to perform heating (convert electrical energy of the storage battery to thermal energy) to regulate a current temperature parameter to the target temperature parameter.

In some embodiments of the present disclosure, by providing the pressure sensor at the portion of the bottoms of the plurality of second movable rods 21 connected with the second spring 23, the pressure exerted by the telescopic elasticity of the first movable rod 20 on the soil and the force exerted by the rotation of the scraping plate 2 on the soil can be reflected, i.e., the expansion effect can be reflected by the pressure data. The expansion effect under different temperatures can be predicted based on the soil data and the temperature data collected by the temperature sensor. The temperature parameter corresponding to the expansion effect that can achieve the predetermined requirement can be selected, and the temperature can be adjusted to the target temperature parameter through the storage battery and the temperature regulation device, thereby avoiding that the expansion effect is reduced (the force is not strong enough to scrape the soil to expand outward) due to the fact that the soil temperature is too low and the hardness is high, the pressure on the soil caused by the telescoping elasticity of the first movable rod 20 gradually decreases and the expansion difficulty gradually increases as the expansion progresses, which is conducive to guaranteeing that the expansion continues to operate smoothly.

Figure 10:
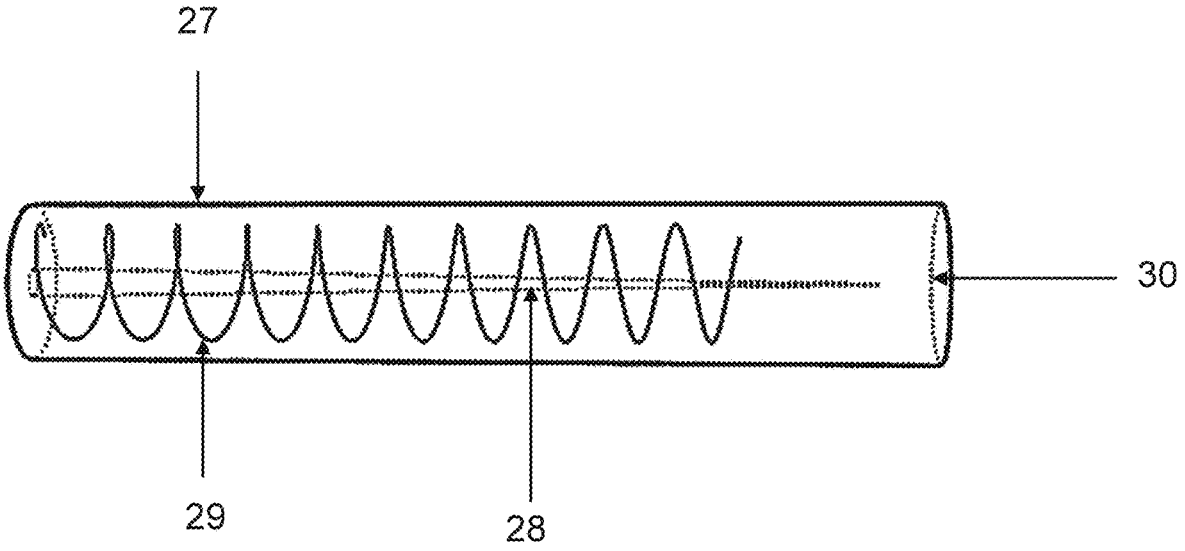
FIG. 10 is a schematic structural diagram illustrating a probe component according to some embodiments of the present disclosure.

In some embodiments, the scraping plate 2 may also include a probe component as illustrated in FIG. 10. The probe component may include a probe channel 27, a probe 28, a third spring 29, and an electrically operated valve 30. The electrically operated valve may be connected with a storage battery in a wired manner. The electrically operated valve may be in communicating connection with a controller and a storage.

The probe component refers to a physical component configured to reinforce a rod-type pile foundation. In some embodiments, the probe component may include the outer probe channel 27, the probe 28, and the third spring 29 arranged inside the probe channel 27, and the electrically operated valve 30 arranged at a top.

The probe channel 27 refers to a channel through which the probe 28 slides. The probe 28 refers to a needle structure capable of being inserted into the soil. The third spring 29 refers to a spring structure that provides an outward releasing force for the probe 28. In some embodiments, the probe channel 27 may be a hollow steel tube. The probe 28 may be a steel needle with a diameter smaller than the probe channel. The third spring 29 may be a high elastic steel spring.

The electrically controlled valve 30 refers to a valve device that is controlled to open or close by an electrical signal. In some embodiments, the electrically controlled valve 30 may determine a state of the valve by receiving a control signal.

In some embodiments, the probe component may be embedded into the scraping plate 2. The probe 28 and the third spring 29 may be provided inside the probe channel 27. A bottom end of the probe channel 27 may be embedded into the scraping plate 2. One end of the third spring 29 may be fixedly connected with the bottom end of the probe channel 27, another end of the third spring 29 may be fixedly connected with one end of the probe 28. The electrically controlled valve 30 may be provided at a top end of the probe channel 27. When the electrically controlled valve 30 is closed, another end of the probe 28 inside the probe channel 27 may be pressed against the electrically controlled valve 30, and the third spring 29 may be in a compressed state. When the electrically controlled valve 30 is opened, the third spring 29 may restore to exert an outward elastic force on the probe 28. Under the action of the force, the end of the probe 28 that originally abuts against the electrically controlled valve 30 may be ejected out of the probe channel 27 to be inserted into the soil.

In some embodiments, the electronically controlled valve 30 may be in communication connection with the controller and the storage to enable the transfer and exchange of information and/or data between various components. For example, the controller may issue a probe regulation instruction to the electronically controlled valve 30, etc. Communication connection modes may include a network, Bluetooth, or the like.

More descriptions regarding the above related parameters and/or components (e.g., the controller, the storage, the probe regulation instruction, etc.) may be found in the related descriptions of the present disclosure.

Figure 11:
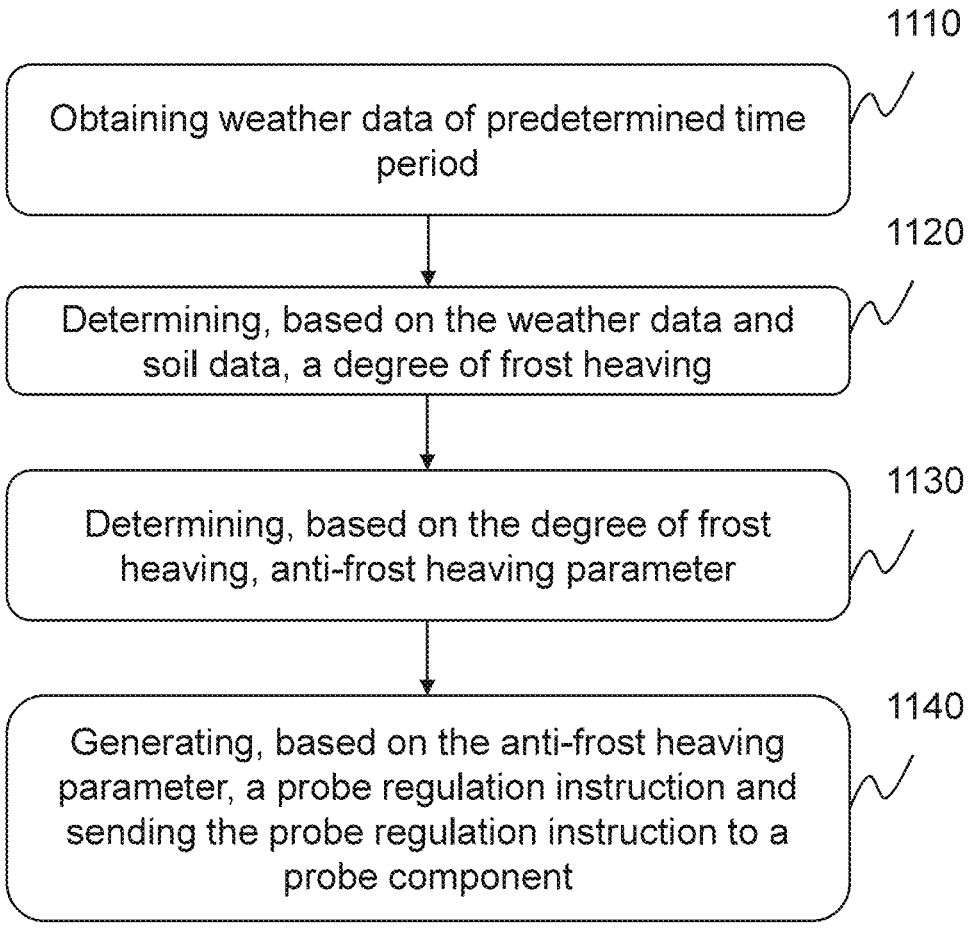
FIG. 11 is a flowchart illustrating an exemplary process for generating a probe regulation instruction according to some embodiments of the present disclosure.

FIG. 11 is a flowchart illustrating an exemplary process for generating a probe regulation instruction according to some embodiments of the present disclosure. As illustrated in FIG. 11, a process 1100 may be executed by a controller. The process 1100 may include the following operations.

In 1110, weather data of a predetermined time period may be obtained.

The weather data refers to relevant data capable of characterizing weather features, such as temperature, humidity, light intensity, wind level, or the like.

The predetermined time period refers to a predetermined time period before and after a current time. For example, a week before or after the current time, or the like.

In some embodiments, the controller may obtain weather data of the predetermined time period in various ways. For example, the controller may obtain weather data (e.g., future weather data may be obtained from a weather forecast APP, historical weather data may be searched from a browser, or the like) of the predetermined time period from a third-party data platform.

In 1120, a degree of frost heaving may be determined based on the weather data and soil data.

The degree of frost heaving refers to a severity of a frost heaving phenomenon. In some embodiments, the degree of frost heaving may include a probability of upward heaving and a net upward heaving amount.

The probability of upward heaving refers to a probability of upward heaving of a pile body of a rod-type pile foundation, such as 50%, 70%, or the like.

The net upward heaving amount refers to a height of upward heaving that may be generated by the pile body of the rod-type pile foundation, such as 0.1 m, 0.2 m, or the like.

In some embodiments, the controller may determine the degree of upward heaving in various ways based on the weather data and the soil data. For example, the controller may construct a second vector database. The second vector database may include a plurality of reference vectors and reference degrees of frost heaving corresponding to the plurality of reference vectors.

Each of the plurality of reference vectors may be constructed based on historical weather data and historical soil data. The reference degrees of frost heaving may be constructed based on historical actual degrees of frost heaving corresponding to the plurality of reference vectors (including a historical probability of frost heaving of 0 or 1, and a historical actual net upward heaving amount). The controller may construct a second target vector based on the current soil data and the current weather data; cluster the plurality of reference vectors in the second vector database, divide the plurality of reference vectors into a second predetermined number (predetermined by the technician based on experience, e.g., 3) of clusters, and determine a clustering center (which is a vector formed by center weather data and center soil data) of each cluster; calculate a similarity between the second target vector and each clustering center to determine a cluster in which the center with a highest similarity is located; use a ratio of a count of the reference vectors in the cluster undergoing frost heaving to a total count of all the reference vectors in the cluster as the probability of upward heaving; and use an average of the reference net upward heaving amounts (e.g., the historical net upward heaving amounts) corresponding to the reference vectors undergoing frost heaving as the net upward heaving amount.

Clustering modes may include, but are not limited to, K-means clustering, or the like. Modes for calculating the similarity may include, but are not limited to, a Euclidean distance algorithm, cosine similarity, or the like. The Euclidean distance is minimal and the cosine similarity is maximal, i.e., the similarity is highest.

Figure 12:
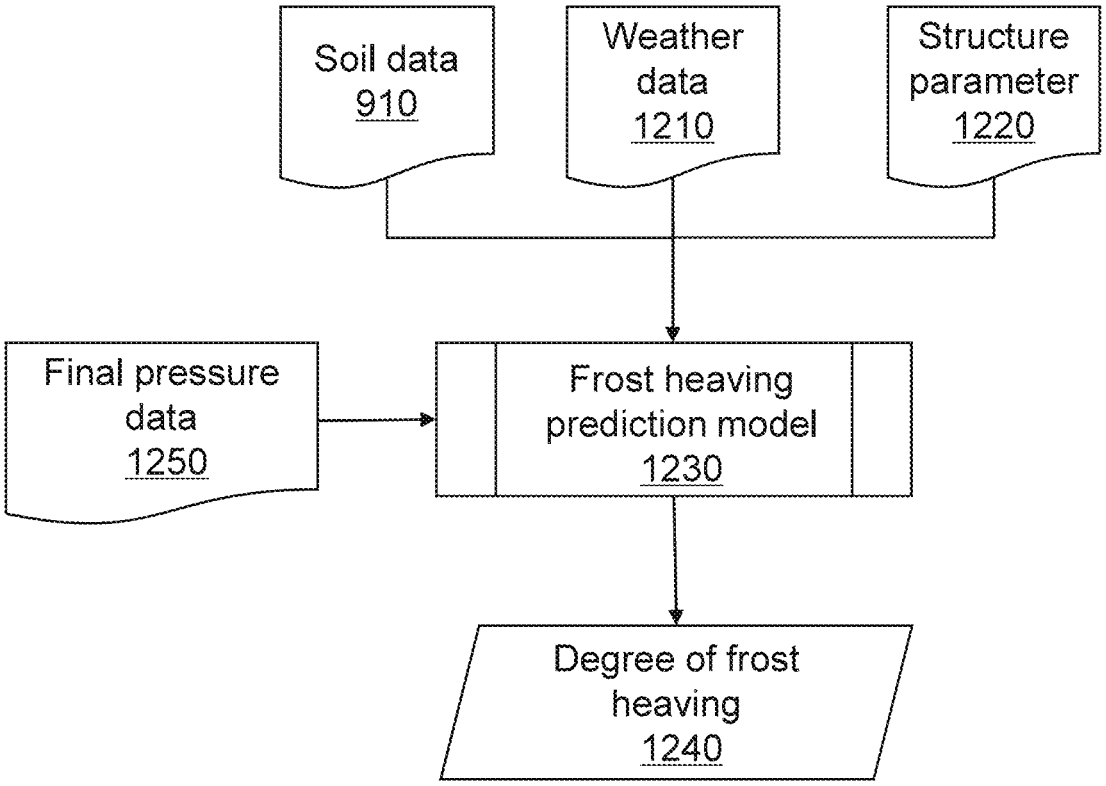
FIG. 12 is a schematic diagram illustrating an exemplary frost heaving prediction model according to some embodiments of the present disclosure.

In some embodiments, as illustrated in FIG. 12, the controller may be further configured to: determine, based on weather data 1210, soil data 910, and a structure parameter 1220, a degree of frost heaving 1240 through a frost heaving prediction model 1230.

The structure parameter 1220 refers to a parameter related to a structure, such as a type of the structure, a total weight of the structure after the structure is assembled, etc. In some embodiments, the structure parameter 1220 may be uploaded to a storage in advance by a technician and then retrieved by the controller.

The frost heaving prediction model 1230 refers to a model for predicting the degree of frost heaving. In some embodiments, the frost heaving prediction model 1230 may be a machine learning model, such as deep neural networks (DNN), a support vector machine (SVM) algorithm, or the like.

In some embodiments, as illustrated in FIG. 12, an input of the frost heaving prediction model 1230 may include the weather data 1210, the soil data 910, and the structure parameter 1220, and the output of the frost heaving prediction model 1230 may include the degree of frost heaving 1240.

In some embodiments, the controller may use sample soil data, sample weather data, and a sample structure parameter as a second training sample, and a historical actual degree of frost heaving as a second label corresponding to the second training sample. The frost heaving prediction model may be trained using the second training sample and the second label. The second training sample may be obtained based on historical data. The second label may be the historical actual degree of frost heaving (including a historical probability of upward heaving of 0 or 1, and a historical net upward heaving amount) corresponding to the second training sample. The second label may be manually labeled. For example, the second label corresponding to the second training sample undergoing frost heaving may be (1, historical net upward heaving amount), and the second label corresponding to the second training sample not undergoing frost heaving may be (0, 0).

In some embodiments, the controller may construct a second loss function based on the degree of frost heaving (the probability of upward heaving and the net upward heaving amount) output by the frost heaving prediction model and the second label, update a parameter using the second loss function, and obtain a trained frost heaving prediction model through parameter updating. A training process of the frost heaving prediction model may be found in the training process of the expansion prediction model, which is not repeated here.

In some embodiments, the input of the frost heaving prediction model 1230 may also include final pressure data 1250 which is monitored by a pressure sensor.

The final pressure data 1250 refers to last data obtained by the pressure transducer when a rod-type pile foundation is deployed. In some embodiments, the final pressure data 1250 may reflect a final expansion effect achieved after the rod-type pile foundation is deployed.

In some embodiments of the present disclosure, the final pressure data may reflect the final expansion effect, and the final expansion effect may affect the ability of the rod-type pile foundation to prevent frost heaving. Therefore, the final pressure data may be added to the input of the model to improve the accuracy of the frost heaving prediction model in predicting the degree of frost heaving.

In some embodiments, the second training sample may further include sample final pressure data. The frost heaving prediction model may be trained using the second training sample and the second label. The sample final pressure data may be historical final pressure data. A training process may be similar to the process described above, which is not described here.

In some embodiments of the present disclosure, the degree of frost heaving can be accurately and quickly determined through the machine learning model based on the soil data, the weather data, and the structure parameter, which is conducive to the reasonable selection of a subsequent anti-frost heaving parameter.

In 1130, an anti-frost heaving parameter may be determined based on the degree of frost heaving.

The anti-frost heaving parameter refers to a parameter of preventing frost heaving. In some embodiments, the anti-frost heaving parameter may include an electronically controlled valve sequence.

The electronically controlled valve sequence refers to a sequence composed of electronically controlled valves to be opened. In some embodiments, each scraping plate 2 may be provided with a probe component. Each probe component may include an electronically controlled valve. Each electronically controlled valve may have a corresponding number (which may be manually calibrated in advance, e.g., an electronically controlled valve 1, an electronically controlled valve 2, . . . , an electronically controlled valve n). The electronically controlled valve sequence may be represented by a sequence including numbers of electronically controlled valves to be opened, such as (1, 3, 5, 7). The electronically controlled valve sequence may reflect a count and a positional distribution of the electronically controlled valves to be opened. Each electronically controlled valve may correspond to each number and each position where the electronically controlled valve is located, and calibrated by the technician in advance and stored in the storage.

In some embodiments, the controller may determine the anti-frost heaving parameter based on the degree of frost heaving in various ways. For example, the controller may determine the anti-frost heaving parameter based on weather data and soil data through a predetermined correspondence. The predetermined correspondence may reflect a correspondence between the weather data and the soil data and the anti-frost heaving parameter. For example, the worse the weather data (e.g., the lower the temperature, the lower the light intensity, the higher the wind level, etc.), the higher the count of the electrically controlled valves to be opened corresponding to the anti-frost heaving parameter. The predetermined correspondence may be preset by the technician according to historical data based on experience or actual needs.

In 1140, a probe regulation instruction may be generated based on the anti-frost heaving parameter, and the probe regulation instruction may be sent to the probe component.

The probe regulation instruction refers to an instruction for controlling the probe component to release a probe. In some embodiments, the controller may automatically generate the probe regulation instruction based on the anti-frost heaving parameter through a predetermined algorithm (e.g., a call function, etc.).

In some embodiments, the controller may send the probe regulation instruction to the electrically controlled valve in the probe component via a network, or the like. The electrically-controlled valve may receive the probe regulation to perform opening or maintaining closing. When the electrically controlled valve is opened, a force may be applied to the probe through a third spring to be inserted into the soil.

In some embodiments of the present disclosure, the probe component can be arranged on the scraping plate 2 to enhance the anti-frost heaving capability of the rod-type pile foundation in extreme weather or under relatively special soil structures. The degree of frost heaving can be predicted based on the soil data and the weather data to determine the anti-frost heaving parameter capable of effectively preventing the frost heaving phenomenon, are then the probe regulation instruction can be generated to control opening and closing of the electronically controlled valve, enabling the corresponding probe to be inserted into the soil under the elasticity of the third spring, and reducing the risk of upward heaving of the pile foundation, thereby increasing the universal applicability of the rod-type pile foundation in various weather and soil structures.

Figure 13:
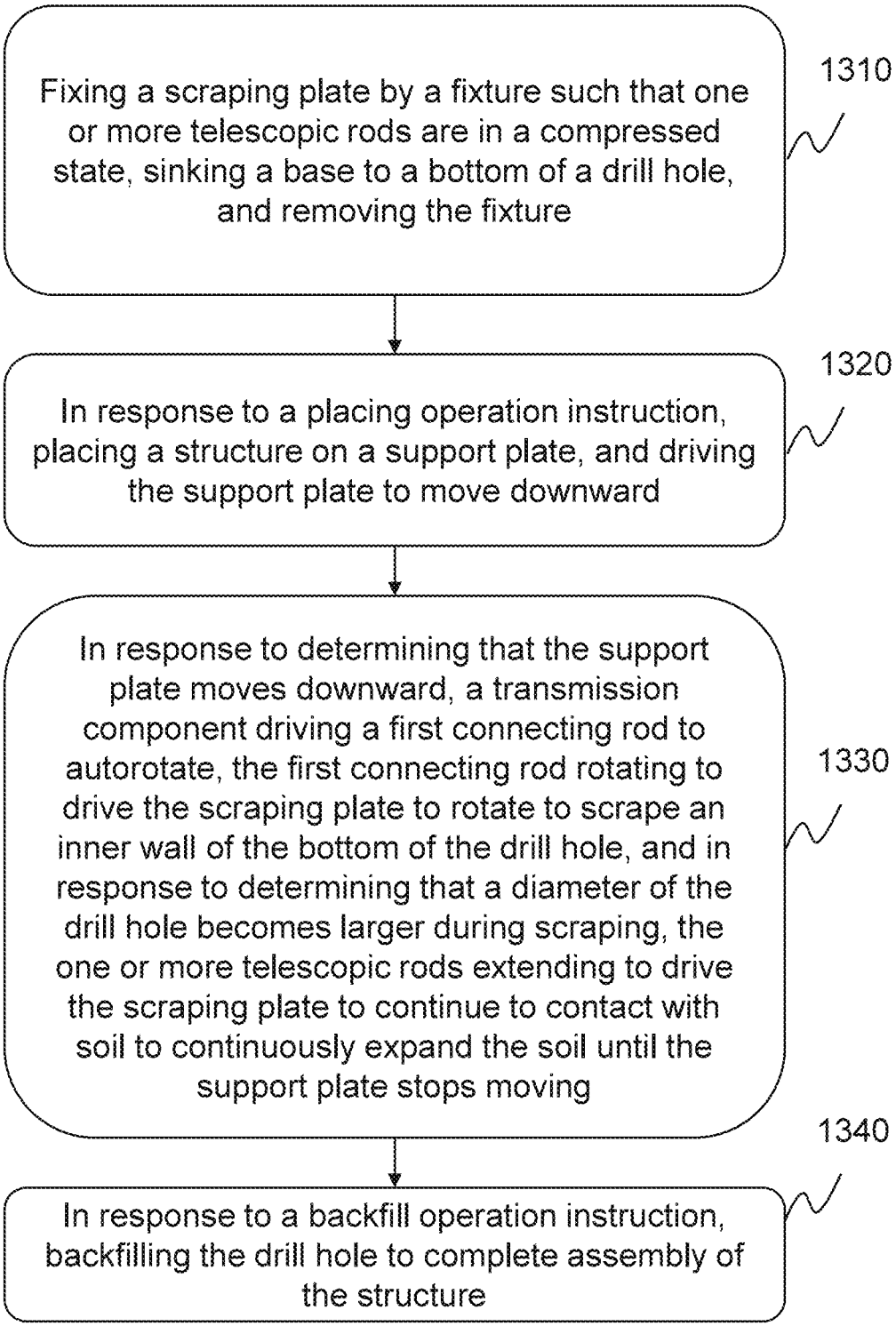
FIG. 13 is a flowchart illustrating an exemplary operating method of a rod-type pile foundation according to some embodiments of the present disclosure.

FIG. 13 is a flowchart illustrating an exemplary opening method of a rod-type pile foundation according to some embodiments of the present disclosure. As illustrated in FIG. 13, a process 1300 may be executed by a controller. The process 1300 may include the following operations.

In 1310, the scraping plate 2 may be fixed by a fixture such that one or more telescopic rods are in a compressed state, the base 1 may be sunk to a bottom of a drilled hole, and the fixture may be removed.

The fixture refers to a device configured to fix the one or more telescopic rods to compress the one or more telescopic rods to a point not exceeding an outer wall of the base, such as a work fixture, etc.

The drilled hole is a pre-drilled hole for placing the rod-type pile foundation. In some embodiments, the drilled hole may be formed by drilling a hole by a drilling device (e.g., a pile driver, a large drilling machine, etc.).

In some embodiments, the controller may control the fixture to fix the scraping plate 2, and slowly sink the base 1 into the drilled hole. A diameter of the drilled hole may be greater than a diameter (to ensure that the base may enter the drilled hole) of the base 1 until the base 1 is sunk to the bottom of the drilled hole, and the fixture may be removed.

In 1320, in response to a placing operation instruction, a structure may be placed on the support plate 4, and the support plate 4 may be driven to move downward.

The placing operation instruction refers to an instruction for placing a structure. In some embodiments, the placing operation instruction may be set by a technician and issued to the controller.

In some embodiments, in response to the placing operation instruction, the controller may place the structure to be assembled on a rod-type pile foundation on the support plate 4 and drive the support plate to move downward by a maneuvering device (e.g., a hoist, etc.). For example, if the structure is the reinforced cage 24, a bottom end of the reinforced cage 24 may abut against the support plate 4, concrete may be poured, and the support plate 4 may be driven to move downward by a compression of the concrete.

In 1330, in response to determining that the support plate 4 moves downward, a transmission component may drive the first connecting rod 3 to autorotate, the first connecting rod may rotate to drive the scraping plate 2 to rotate to scrape an inner wall of the bottom of the drilled hole, and in response to determining that the diameter of the drilled hole becomes larger during scraping, the one or more telescopic rods may extend to drive the scraping plate to continue to contact with the soil to continuously expand the soil until the support plate 4 stops moving.

In some embodiments, when the support plate 4 stops moving, the one or more telescopic rod may maximize the expansion to the bottom of the hole. The scraping plate 2 may be embedded into the bottom of the hole to provide a pivot point for a pile body, thereby avoiding the pile body from being heaving by a tangential frost heaving force.

In 1340, in response to a backfill operation instruction, the drilled hole may be backfilled to complete assembly of the structure.

The backfill operation instruction refers to an instruction to backfill the drilled hole. In some embodiments, the backfill operation instruction may be set by the technician and issued to the controller.

In some embodiments, in response to the backfill operation instruction, the controller may backfill the drilled hole until assembly of the structure is completed. For example, if the construct is the reinforced cage 24, backfilling may continue until concrete pouring is completed.

More descriptions regarding operations 1310-1340 may be found in the related descriptions above (FIGS. 1-5).

In some embodiments of the present disclosure, the operating method of the rod-type pile foundation is simple in operation, high in efficiency, and low in cost. With application of the rod-type pile foundation, the pivot point can be formed at the bottom of the drilled hole, so that the pile body can be prevented from being heaved upward by the upward frost heaving force, thereby ensuring that the stability of the superstructure, and prolonging the service life of the pile foundation.

The basic concept has been described above. Obviously, for those skilled in the art, the above detailed disclosure is only an example, and does not constitute a limitation to the present disclosure. Although not expressly stated here, those skilled in the art may make various modifications, improvements and corrections to the present disclosure. Such modifications, improvements and corrections are suggested in this disclosure, so such modifications, improvements and corrections still belong to the spirit and scope of the exemplary embodiments of the present disclosure.

Meanwhile, the present disclosure uses specific words to describe the embodiments of the present disclosure. For example, "one embodiment", "an embodiment", and/or "some embodiments" refer to a certain feature, structure or characteristic related to at least one embodiment of the present disclosure. Therefore, it should be emphasized and noted that references to "one embodiment" or "an embodiment" or "an alternative embodiment" two or more times in different places in the present disclosure do not necessarily refer to the same embodiment. In addition, certain features, structures, or characteristics in one or more embodiments of the present disclosure may be properly combined.

In addition, unless clearly stated in the claims, the sequence of processing elements and sequences described in the present disclosure, the use of counts and letters, or the use of other names are not used to limit the sequence of processes and methods in the present disclosure. While the foregoing disclosure has discussed by way of various examples some embodiments of the invention that are presently believed to be useful, it should be understood that such detail is for illustrative purposes only and that the appended claims are not limited to the disclosed embodiments, but rather, the claims are intended to cover all modifications and equivalent combinations that fall within the spirit and scope of the embodiments of the present disclosure. For example, although the implementation of various components described above may be embodied in a hardware device, it may also be implemented as a software only solution, e.g., an installation on an existing server or mobile device.

In the same way, it should be noted that in order to simplify the expression disclosed in this disclosure and help the understanding of one or more embodiments of the invention, in the foregoing description of the embodiments of the present disclosure, sometimes multiple features are combined into one embodiment, drawings or descriptions thereof. This method of disclosure does not, however, imply that the subject matter of the disclosure requires more features than are recited in the claims. Rather, claimed subject matter may lie in less than all features of a single foregoing disclosed embodiment.

In some embodiments, counts describing the quantity of components and attributes are used. It should be understood that such counts used in the description of the embodiments use the modifiers "about", "approximately" or "substantially" in some examples. Unless otherwise stated, "about", "approximately" or "substantially" indicates that the stated figure allows for a variation of ±20%. Accordingly, in some embodiments, the numerical parameters used in the disclosure and claims are approximations that can vary depending upon the desired characteristics of individual embodiments. In some embodiments, numerical parameters should consider the specified significant digits and adopt the general digit retention method. Although the numerical ranges and parameters used in some embodiments of the present disclosure to confirm the breadth of the range are approximations, in specific embodiments, such numerical values are set as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and described.

What is claimed is:

1. A rod-type pile foundation for preventing a pile body from being heaved, comprising a base, a support block fixed inside the base, a support plate movably disposed at a top of the support block by a guide structure, and an anti-frost heaving component located at a lower portion of the support block, wherein:

the anti-frost heaving component includes a first connecting rod rotationally connected with the support block and one or more telescopic rods, one end of each of the one or more telescopic rods is fixed on the first connecting rod, a scraping plate is fixed at another end of each of the one or more telescopic rods, and the scraping plate protrudes from an outer wall of the base when the one or more telescopic rods are in an extended state; and the support plate is in transmission connection with the first connecting rod through a transmission component, and the transmission component converts a vertical linear motion of the support plate into a rotation of the first connecting rod.

2. The rod-type pile foundation of claim 1, wherein the transmission component includes a first slide rod, a first gear coaxially fixed on the first connecting rod, a second gear and a third gear which are coaxially provided, a second bevel gear and a fifth gear which are coaxially provided, and a fourth gear and a first bevel gear which are coaxially provided, wherein:

a top of the first slide rod is fixed on a bottom surface of the support plate, a sidewall of the first slide rod is uniformly provided with toothed blocks, the first slide rod is meshed with the fifth gear, the fifth gear coaxially drives the second bevel gear to rotate, the second bevel gear is meshed with the first bevel gear, the first bevel gear coaxially drives the fourth gear to rotate, the fourth gear is meshed with the third gear, the third gear coaxially drives the second gear to rotate, and the second gear is meshed with the first gear.

3. The rod-type pile foundation of claim 1, wherein the guide structure includes one or more second slide rods, one end of each of the one or more second slide rods is fixed on a bottom surface of the support plate, another end of each of the one or more the second slide rods is inserted into the support block and movably connected with the support block, each of the one or more second slide rods is externally sleeved with a first spring, one end of the first spring abuts against the bottom surface of the support plate, and another end of the first spring abuts against an upper surface of the support block.

4. The rod-type pile foundation of claim 3, wherein a count of the second slide rods is a first number not less than a first threshold, and the first number of the second slide rods are distributed in a circumferential array with respect to an axis of the support plate.

5. The rod-type pile foundation of claim 1, wherein a count of the one or more telescoping rods is a second number not less than a second threshold, and the second number of the telescoping rods are distributed in a circumferential array with respect to an axis of the first connecting rod.

6. The rod-type pile foundation of claim 1, wherein each of the one or more telescopic rods includes a second movable rod and a first movable rod movably sleeved within and not disengaged from the second movable rod, one end of the second movable rod is fixed on a bottom sidewall of the first connecting rod, one end of the first movable rod is inserted into a slide groove inside the second movable rod through an opening in another end of the second movable rod and compresses a second spring disposed in the slide groove, and the scraping plate is fixed at another end of the first movable rod.

7. The rod-type pile foundation of claim 1, wherein the scraping plate is a curved plate or a circular plate, one or more spherical rods are provided on an outer wall of the scraping plate, an end of each of the one or more spherical rods is spherical, another end of each of the one or more spherical rods is rotatably connected with the scraping plate, and the one or more spherical rods are uniformly provided on a sidewall of the scraping plate.

8. The rod-type pile foundation of claim 7, wherein tiny bumps are uniformly provided on a surface of the spherical end of each of the one or more spherical rods, and a material of the tiny bumps is memory alloy.

9. The rod-type pile foundation of claim 1, wherein a filter hole is provided in an outer wall plate of the scraping plate, and a heater or a temperature regulation device is provided inside the scraping plate.

10. The rod-type pile foundation of claim 9, wherein the rod-type pile foundation is provided with a storage battery, at least one of one or more spherical rods is provided with a temperature sensor, and a portion of bottoms of a plurality of second movable rods connected with the second spring is provided with a pressure sensor;

the temperature regulation device, the temperature sensor, and the pressure sensor are electrically connected with the storage battery, the temperature regulation device, the temperature sensor, and the pressure sensor are in communication connection with a controller and a storage; and the controller is configured to:

obtain soil data and temperature data collected by the temperature sensor;

generate candidate temperature parameters;

determine, based on the soil data and the temperature data, an expansion effect corresponding to each candidate temperature parameter;

determine a candidate temperature parameter of which the expansion effect satisfies a predetermined requirement as a target temperature parameter; and generate, based on the target temperature parameter, a temperature regulation instruction and send the temperature regulation instruction to the temperature regulation device.

11. The rod-type pile foundation of claim 10, wherein the controller is further configured to:

determine, based on the soil data, the temperature data, the candidate temperature parameters, and a predetermined duration, the expansion effect through an expansion prediction model, the expansion prediction model being a machine learning model.

12. The rod-type pile foundation of claim 11, wherein an input of the expansion prediction model further includes an assembly parameter.

13. The rod-type pile foundation of claim 1, wherein the scraping plate further includes a probe component, the probe component includes a probe channel, a probe, a third spring, and an electronically controlled valve, the electronically controlled valve is connected with a storage battery in a wired manner, and the electronically controlled valve is in communicating connection with a controller and a storage; and the controller is configured to:

obtain weather data of a predetermined time period;

determine, based on the weather data and soil data, a degree of frost heaving;

determine, based on the degree of frost heaving, an anti-frost heaving parameter; and generate, based on the anti-frost heaving parameter, a probe regulation instruction and send the probe regulation instruction to the probe component.

14. The rod-type pile foundation of claim 13, wherein the controller is further configured to:

determine, based on the weather data, soil data, and a structure parameter, the degree of frost heaving through a frost heaving prediction model, the frost heaving prediction model being a machine learning model.

15. The rod-type pile foundation of claim 14, wherein an input of the frost heaving prediction model further includes final pressure data, the final pressure data being monitored by a pressure sensor.

16. An operating method of the rod-type pile foundation for preventing a pile body from being heaved of claim 1, wherein the operating method is performed by a controller, and the operating method comprises:

fixing the scraping plate by a fixture such that the one or more telescopic rods are in a compressed state, sinking the base to a bottom of a drilled hole, and removing the fixture, wherein a diameter of the drilled hole is greater than a diameter of the base;

in response to a placing operation instruction, placing a structure on the support plate, and driving the support plate to move downward;

in response to determining that the support plate moves downward, the transmission component driving the first connecting rod to autorotate, the first connecting rod rotating to drive the scraping plate to rotate to scrape an inner wall of the bottom of the drilled hole, and in response to determining that the diameter of the drilled hole becomes larger during scraping, the one or more telescopic rods extending to drive the scraping plate to continue to contact with soil to continuously expand the soil until the support plate stops moving; and in response to a backfill operation instruction, backfilling the drilled hole to complete assembly of the structure.

* * * * *